US011643245B2

(12) United States Patent
Hengami

(10) Patent No.: US 11,643,245 B2
(45) **Date of Patent: *May 9, 2023**

(54) CONVENIENT SOLID PRODUCT DISPENSING PACKAGE

(71) Applicant: David Todjar Hengami, Torrance, CA (US)

(72) Inventor: David Todjar Hengami, Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/356,919

(22) Filed: Jun. 24, 2021

(65) Prior Publication Data

US 2021/0316898 A1 Oct. 14, 2021

Related U.S. Application Data

(63) Continuation of application No. 17/086,161, filed on Oct. 30, 2020, now Pat. No. 11,066,209.

(Continued)

(51) Int. Cl.
*B65D 5/72* (2006.01)
*B65D 5/02* (2006.01)

(Continued)

(52) U.S. Cl.
CPC ..... *B65D 5/723* (2013.01); *B65B 5/024* (2013.01); *B65B 5/062* (2013.01); *B65D 5/0227* (2013.01)

(58) Field of Classification Search
CPC ..... B65D 5/723; B65D 5/0227; B65D 5/029; B65D 5/6608; B65D 85/60; B65D 5/646; B65D 5/72

(Continued)

(56) References Cited

U.S. PATENT DOCUMENTS 958,707 A 5/1910 Stafford
1,543,953 A 6/1925 Rothschild (Continued)

FOREIGN PATENT DOCUMENTS

CN 204399639 12/2014
DE 10044018 9/2000

(Continued)

OTHER PUBLICATIONS https://issuu.com/designpackaging/docs/packaging-dielines-free-book-design—Packaging & Dielines: The Designer's Book of Packaging Dieline; published at least as early as Sep. 18, 2019; 2 pages.

(Continued)

*Primary Examiner* — Christopher R Demeree
(74) *Attorney, Agent, or Firm* — Scott R. Hansen; Viking IP Law

(57) ABSTRACT

A blank used to form a hexagonal shaped box, the blank having a front sidewall and a back sidewall, a first sidewall having a first sidewall top flap and a first sidewall bottom flap, a second sidewall having a second sidewall top flap and a second sidewall bottom flap, a second sidewall bottom flap extension foldably connected to the second sidewall bottom flap, a third sidewall having a third sidewall top panel, a fourth sidewall having a fourth sidewall top flap and a fourth sidewall bottom flap, a fourth sidewall bottom flap extension foldably connected to the fourth sidewall bottom flap, an inner sidewall foldably connected to the fourth sidewall, an inner sidewall flap foldably connected to the inner sidewall, a top panel including an aperture for dispensing food product there through, a bottom panel foldably connected to the front sidewall, and a slide foldably connected to the front sidewall.

17 Claims, 18 Drawing Sheets

Related U.S. Application Data

(60) Provisional application No. 62/928,299, filed on Oct. 30, 2019.

(51) Int. Cl.
*B65B 5/06* (2006.01)
*B65B 5/02* (2006.01)

(58) Field of Classification Search
USPC .... 229/129.1, 131.1, 132, 220, 108, 125.12, 229/110; 426/115; 222/105, 476
See application file for complete search history.

(56) References Cited

U.S. PATENT DOCUMENTS 1,951,274 A 3/1934 Denman
2,000,210 A * 5/1935 Bayless ..... B65D 5/701 229/131.1
2,330,926 A 10/1943 Rous
2,342,081 A 2/1944 Kirkland et al.
2,348,748 A 5/1944 Otto et al.
2,507,430 A 5/1950 Yancey
2,857,881 A 10/1958 Beebe
2,903,175 A 9/1959 Peimer
2,950,851 A 8/1960 Peimer
2,983,421 A 5/1961 Turpin
3,009,565 A 11/1961 Leone
3,016,178 A 1/1962 Knocks
3,033,436 A 5/1962 Peimer
3,040,953 A 6/1962 Tindall
3,079,062 A 2/1963 Craddock
3,082,929 A 3/1963 Aquino et al.
3,115,290 A 12/1963 Byassee
3,126,141 A 3/1964 Walter
3,229,888 A 1/1966 Gilliam
3,438,482 A 4/1969 Hamilton
3,441,125 A 4/1969 Small
3,539,089 A 11/1970 Osberg
3,610,510 A 10/1971 Lowry
3,669,336 A 6/1972 Robinson
3,819,093 A 6/1974 Forbes
3,907,108 A 9/1975 Weimer
4,054,203 A 10/1977 Farquhar
4,063,679 A 12/1977 Henry
4,081,128 A 3/1978 O'Neill
4,094,456 A 6/1978 Raccaforte
4,141,485 A 2/1979 Lambert
4,197,985 A 4/1980 Austin
4,201,329 A 5/1980 Roccaforte
4,274,578 A 6/1981 Monteaiegre
4,349,105 A 9/1982 Bradley et al.
4,361,270 A 11/1982 Roccaforte
4,452,355 A 6/1984 Benham
4,609,142 A 9/1986 Adamek
5,040,721 A 8/1991 Essack
D319,976 S 9/1991 Wortley et al.
D320,935 S 10/1991 Nylander
5,056,708 A 10/1991 Boyle et al.
5,135,158 A 8/1992 Boyle
5,145,070 A 9/1992 Pallett et al.
5,197,625 A 3/1993 Mullaney
5,348,219 A 9/1994 Brintazzoli
D361,262 S 8/1995 Lusker
5,465,834 A 11/1995 Sieber et al.
5,505,370 A 4/1996 Brown
5,505,373 A 4/1996 von Stillfried
5,540,330 A 7/1996 Lo Duca
5,607,058 A 3/1997 Huesman et al.
D390,330 S 2/1998 Skaya
5,725,620 A 3/1998 Perea et al.
5,845,424 A 12/1998 Mitchell
5,918,799 A 7/1999 Walsh
5,927,498 A 7/1999 Saam
D425,413 S 5/2000 Heeley et al.
6,079,563 A 6/2000 Katchmazenski
6,116,499 A 9/2000 Hengami
6,227,440 B1 5/2001 Hart
6,273,332 B1 8/2001 Hengami
6,360,942 B2 3/2002 Hengami
D455,455 S 4/2002 Katsuyama
6,393,707 B1 5/2002 Maffei
6,394,275 B1 5/2002 Paliotta et al.
6,435,402 B1 8/2002 Hengami
6,474,040 B1 11/2002 Ours et al.
6,637,646 B1 10/2003 Muise et al.
6,691,869 B2 2/2004 Knaack et al.
6,733,555 B1 5/2004 Wilder
6,889,892 B2 5/2005 Walsh et al.
D508,850 S 8/2005 Ghini et al.
6,945,449 B2 * 9/2005 Hengami ..... B65D 77/064 229/131.1
6,971,524 B1 12/2005 Voswinkel
7,040,528 B2 5/2006 Hengami
7,097,043 B2 8/2006 Hsu
7,156,286 B2 1/2007 Hengami
D551,967 S 10/2007 Hengami
D552,987 S 10/2007 Magnusson
7,337,904 B2 3/2008 Hengami
D580,754 S 11/2008 An
7,494,044 B2 2/2009 Walsh et al.
7,503,475 B2 * 3/2009 McGowan ..... B65D 5/723 222/476
D594,743 S 6/2009 Lukka
7,661,578 B2 2/2010 Li
7,743,973 B2 6/2010 Hegami
7,992,764 B2 8/2011 Magnusson
8,261,964 B2 9/2012 Raupach et al.
8,499,999 B2 8/2013 Sieber et al.
8,739,969 B2 6/2014 Schuld
8,800,855 B2 8/2014 Fitzwater
8,844,797 B2 * 9/2014 Smith ..... B65D 5/60 229/110
9,085,386 B2 7/2015 Hengami
9,394,066 B2 7/2016 Hengami
9,394,076 B2 * 7/2016 Hengami ..... B65D 5/0227
9,561,878 B2 2/2017 Lee
9,643,749 B2 * 5/2017 Wagner ..... B65D 77/062
10,086,990 B2 10/2018 Hengami
11,066,209 B2 7/2021 Hengami
11,111,052 B2 9/2021 Hengami
11,180,281 B2 11/2021 Hengami
11,186,405 B2 11/2021 Hengami
11,220,369 B2 1/2022 Hengami
11,292,634 B2 4/2022 Hengami
2003/0217944 A1 11/2003 Belloli et al.
2003/0230498 A1 12/2003 Maute
2004/0065723 A1 4/2004 Hengami
2005/0061864 A1 3/2005 Lee
2005/0067476 A1 3/2005 Hengami
2005/0098616 A1 5/2005 Chang
2005/0211754 A1 9/2005 Fulcher
2006/0124709 A1 6/2006 Hengami
2007/0251848 A1 11/2007 Hengami
2007/0261990 A1 11/2007 Weston
2008/0128478 A1 * 6/2008 Quadrelli ..... B65D 85/60 426/115
2008/0128480 A1 6/2008 Hengami
2011/0057024 A1 3/2011 Sieber et al.
2011/0062175 A1 3/2011 Nakamura et al.
2011/0111938 A1 5/2011 Smith
2011/0162997 A1 7/2011 Robbins et al.
2011/0168767 A1 7/2011 Hengami
2013/0075462 A1 3/2013 Jones et al.
2015/0321788 A1 11/2015 Hengami
2016/0297589 A1 10/2016 You et al.

FOREIGN PATENT DOCUMENTS

EP 0642977 4/1996
EP 0732269 9/1996
EP 0761550 3/1997

(56) References Cited

FOREIGN PATENT DOCUMENTS

| | | |
|---|---|---|
| FR | 2799743 | 4/2001 |
| JP | 07223634 | 8/1995 |

OTHER PUBLICATIONS http://samanthaleewalker.biogspot.in/2012/12/ornament-box-tutoriai.html / Samantha Walker's Imaginary World: Ornamental Box Tutorial; retrieved Aug. 2, 2018; 1 page.
https://www.pinterest.se/pin/15692298672213867/?Ip-true / / Corrugated Box with internal insert #packaging; retrieved Aug. 2, 2018; 1 page.
https://www.pinterest.nz/pin/6848856808218 // Pinterest; retrieved August 2, 2018; 1 page.
PCT/US2022/34764. international Search Report and Written Opinion dated Oct. 19, 2022.

* cited by examiner

CONVENIENT SOLID PRODUCT DISPENSING PACKAGE

CROSS-REFERENCE TO RELATED APPLICATIONS

This United States Non-Provisional patent application is a Continuation of U.S. Non-Provisional patent application Ser. No. 17/086,161, titled "Convenient Solid Product Dispensing Package," filed Oct. 30, 2020, which claims priority to U.S. Provisional Patent Application Ser. No. 62/928,299, titled "Convenient Solid Product Dispensing Package," filed Oct. 30, 2019, the contents of which are incorporated by reference in their entirety.

BACKGROUND

Many vehicles have circular cup holders for drinks to be conveniently held. Similarly, movie theaters, sports arenas and the like have seats with adjacent cup holders to hold drinks. Candy or other small piece of food (e.g. popcorn), however, are typically sold in flexible paper or plastic bags which are difficult to seal or store in a moving vehicle or to keep on one's person while watching a movie or sports game. Once the packages are opened, the candy or food pieces are often spilled onto the seats and can become sticky, or otherwise soil the seat and areas nearby.

Present candy and food packages are generally rectangular, and major food and candy manufacturers employ high-speed seal-end form fill and seal packaging machines to produce the packages at many units per minute. The rectangular packages also generally lack a secure closing means to prevent spillage and are of a size and configuration such that there is normally no convenient way to securely store them in a cup holder.

Round candy and food packaging is made generally from plastic or metal materials. To the extent round packaging is made from paperboard, the packaging may lack structural integrity and require assembly by hand or with a very expensive custom-designed, and neither is a cost effective option as far as manufacturing companies are concerned because the custom-designed machines are generally not commonly owned by product packaging and distribution centers, to assemble and fill the round packaging.

Applicant's previous hexagonal boxes, e.g. U.S. patent publication nos. 2005-0067476A1, 2006-0124709A1, were not efficient in forming the bottom of the box. In previous boxes the bottom end included one hexagonally-shaped bottom end with three small tabs foldably connected thereto. Closure of the box was achieved in a multi-step process by folding the hexagonal bottom end over internally-folded portions of the box and then folding each tab upward to adhesively connect to corresponding sidewalls of the box. Previous disclosures also presented integrity concerns because the only means to secure the bottom of the box was the small tabs connected to the sidewalls. This complicated folding process required that the previous hexagonal boxes be folded and assembled by hand. They were not machinable because the existing seal-end form and fill machines could not line up the body of the box, and then line up the flaps and then fold and glue all of the tabs that were spaced around the perimeter for the box. It was simply too complicated. And if the previous hexagonal boxes were not lined up properly when being formed, the end result would be crooked and defective boxes.

Accordingly, one important objective is to provide a structurally-sound dispensing package with a one-step, automatic bottom closure which may be conveniently stored in a cup holder, utilizing the same high-speed form, fill and seal packaging machine used to form rectangular cardboard or paperboard packaging.

SUMMARY

The present invention satisfies this need. In an embodiment, the present invention is directed to my blank used to form a hexagonal shaped box. The blank has a front sidewall, a back sidewall, a first sidewall, a second sidewall, a second sidewall bottom flap extension, a third sidewall, a fourth sidewall, a fourth sidewall bottom flap extension, an inner sidewall, an inner sidewall flap, a top panel, a bottom panel and a slide.

The front sidewall is foldably connected to the back sidewall and the back sidewall can include a back sidewall adhesive area.

The first sidewall is foldably connected to the back sidewall. The first sidewall can have a first sidewall top flap and a first sidewall bottom flap foldably connected to the first sidewall.

The second sidewall is foldably connected to the first sidewall opposite the back sidewall. The second sidewall can have a second sidewall top flap and a second sidewall bottom flap foldably connected to the second sidewall.

The second sidewall bottom flap extension is foldably connected to the second sidewall bottom flap opposite the side second sidewall.

The third sidewall is foldably connected to the front sidewall opposite the second sidewall. The third sidewall can have a third sidewall top panel foldably connected to the third sidewall.

The fourth sidewall is foldably connected to the third sidewall opposite the front sidewall. The fourth sidewall can have a fourth sidewall top flap and a fourth sidewall bottom flap foldably connected to the fourth sidewall.

The fourth sidewall bottom flap extension is foldably connected to the fourth sidewall bottom flap opposite the fourth sidewall.

The inner sidewall is foldably connected to the fourth sidewall opposite the third sidewall. The inner sidewall can have inner sidewall stops and an inner bottom support panel foldably connected to the inner sidewall.

The inner sidewall flap is foldably connected to the inner sidewall opposite the fourth sidewall. An outer surface of the inner sidewall flap can include an inner sidewall adhesive area.

The top panel is foldably connected to the front sidewall and includes an aperture for dispensing food product there through.

The bottom panel is foldably connected to the front sidewall opposite the top panel.

The slide is foldably connected to the front sidewall opposite the back sidewall. The slide can include angled stop portions and slide stops adjacent the angled stop portions.

Optionally, the first sidewall top flap has a first slit and the fourth sidewall top flap has a second slit.

Optionally, the top panel has a top panel first flap and a top panel second flap configured for insertion into the first slit and the second slit, respectively.

In another embodiment, the present invention is directed to my method of folding the blank. The method comprises the steps of:

a) folding the fourth sidewall and the first sidewall at substantially ninety degrees towards the front sidewall;

b) folding the third sidewall and the fourth sidewall;

c) folding the inner sidewall over the front sidewall and folding the inner sidewall flap at substantially ninety degrees;

d) folding the back sidewall such that the back sidewall adhesive area contacts the inner sidewall such that the back sidewall and inner sidewall are adhesively connected:

e) folding the bottom panel substantially at ninety degrees toward an interior of the partially formed hexagonal box;

f) folding first sidewall bottom flap and the third sidewall bottom flap on top of the bottom panel;

g) folding the second sidewall bottom flap and the fourth sidewall bottom flap such that fourth sidewall bottom flap extension overlaps and is glued to at least a portion of the third sidewall bottom flap and the second sidewall bottom flap extension overlaps and is glued to at least a portion of the first sidewall bottom flap;

h) folding the inner bottom support panel onto the folded bottom panel such that a portion of the inner bottom support panel is glued to the bottom panel;

i) folding the first sidewall top flap, a second sidewall top flap, third sidewall top flap, and fourth sidewall top flap substantially ninety degrees towards the interior of the partially formed hexagonal box; and j) folding the slide substantially ninety degrees towards the interior of the partially formed hexagonal box and folding the top panel substantially ninety degrees and above the slide, such that the top panel is glued to the first sidewall top flap and overlapping second sidewall top flap, and fourth sidewall top flap and overlapping third sidewall top flap, respectively.

Optionally, after h) and before step i) candy or small food pieces are placed into the box.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION

Figure 1:
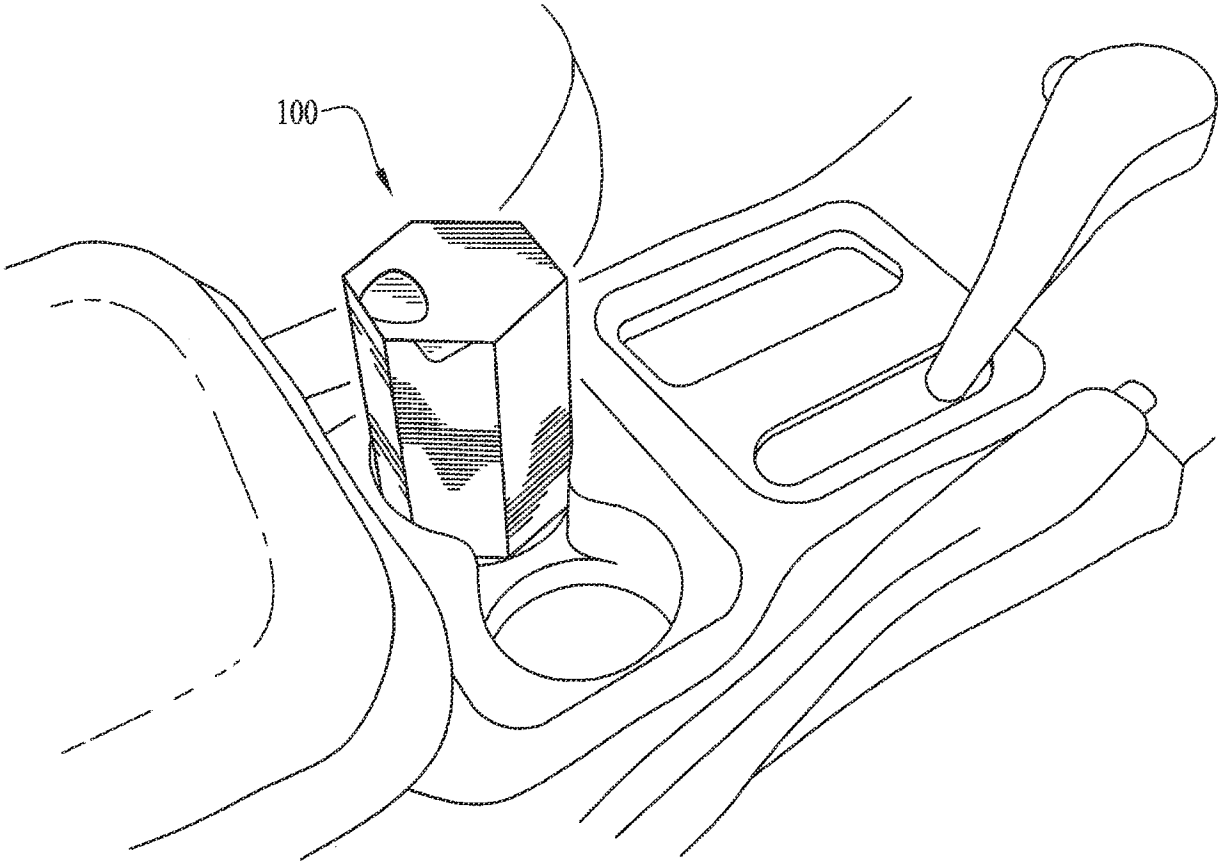
FIG. 1 is a perspective view of a first embodiment of a solid product dispensing package or box illustrating the principles of the box, mounted in one of the drink holders in a vehicle.

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

All dimensions specified in this disclosure are by way of example only and are not intended to be limiting. Further, the proportions shown in these Figures are not necessarily to scale. As will be understood by those with skill in the art with reference to this disclosure, the actual dimensions and proportions of any system, any device or part of a device disclosed in this disclosure will be determined by its intended use.

Referring now to the drawings, wherein like reference numerals designate identical or corresponding features throughout the several views. Further, described herein are certain non-limiting embodiments of my invention.

Figure 13:
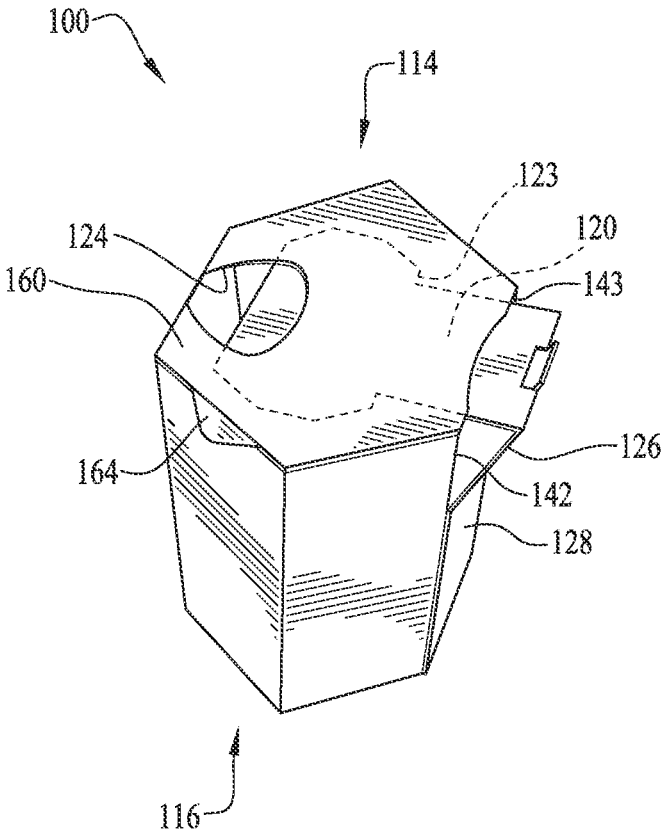
FIG. 13 shows a perspective view of the assembled box in an upright position.

FIG. 1 illustrates a first embodiment of an assembled hexagonally-shaped product dispensing package or box 100 installed in a cup holder of a conventional automobile. As shown in FIG. 13, the hexagonal container or box 100 has a product-dispensing aperture 124 preferably in the top end 114 of the hexagonal container or box 100. A slide 120 integrally formed from the box material and placed under a top panel 160 may be selectively moved to open or close the aperture 124. The slide 120 is foldably connected to an actuating sidewall 126 and a back sidewall 128 is foldably connected to the actuating sidewall 126 opposite the slide 120. A buck sidewall 128 is adhesively connected to an inner sidewall 142, permitting the actuation sidewall 126 to move independent of the back sidewall 128 and facilitate movement of the slide 120 to open or close the aperture 124. The inner sidewall 142 includes inner sidewall stops 143 (FIG. 1) and the slide 120 includes slide stops 123 configured such that when the slide 120 is moved to an open position, interaction between the inner sidewall stops 143 and slide stops 123 prevent the slide 120 from dislodging from the box 100. The actuation sidewall 126 may also serve as a handle for removing the box 100 from a vehicle drink holding receptacle, and for passing the box to others, for example.

Figure 2:
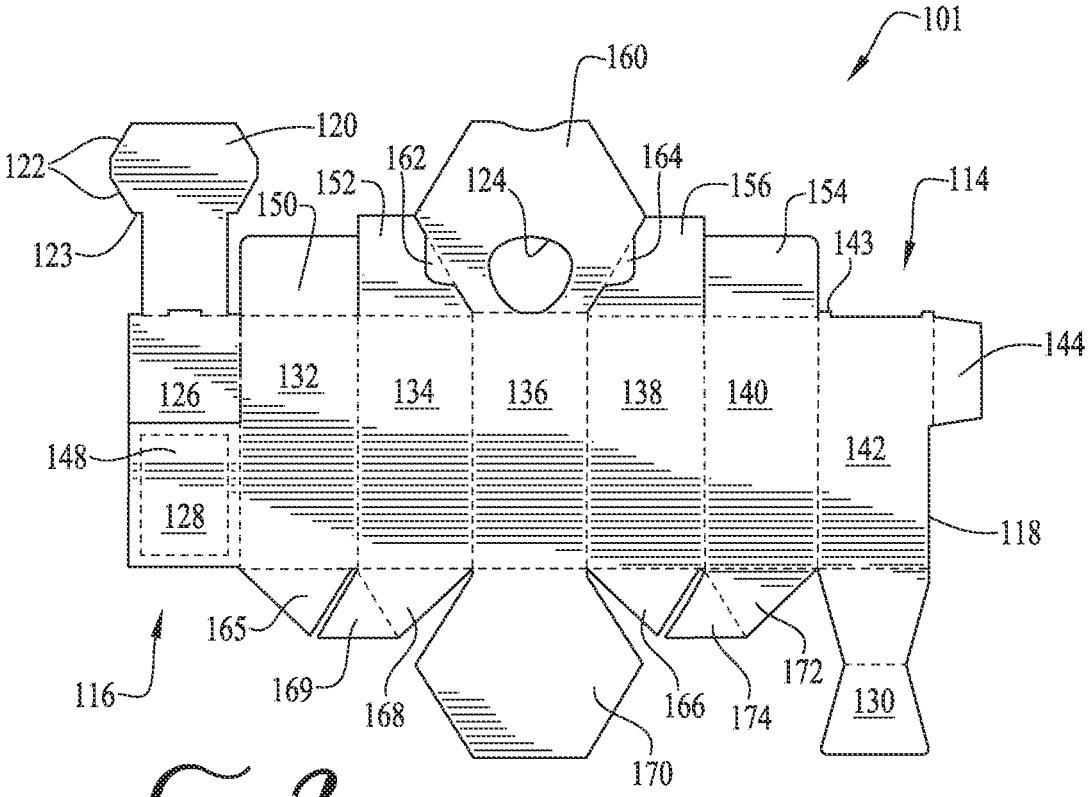
FIG. 2 is a flat pattern view of a cardboard or paperboard blank of the first embodiment which can be folded to form the hexagonal container or box with slide opening.

FIG. 2 illustrates a die cut paper or cardboard blank 101 that may be used to form the box 100 (FIG. 13). The cardboard blank 101 has a top end 114 and a bottom end 116 and is scored for folding such that the box 100 is a hexagonal shape. Major portions of the cardboard blank 101 include a front sidewall 136, back sidewall 128, inner sidewall 142, first sidewall 132, second sidewall 134, third sidewall 138, fourth sidewall 140, top panel 160, bottom panel 170 and 120 slide.

Still referring to FIG. 2, the actuation sidewall 126 is foldably connected to the back sidewall 128, and the slide 120 is foldably connected to the actuation sidewall 126 opposite the back sidewall 128. The back sidewall 128 includes a back sidewall adhesive area 148. The slide 120 includes angled stop portions 122 adjacent the top end 114 of the slide 120, and the slide stops 123 are adjacent the angled stop portions 122. The first sidewall 132 is foldably connected to the back sidewall 128, and the second sidewall 134 is foldably connected to the first sidewall 132 opposite the back sidewall 128. The first sidewall 132 includes a first sidewall top flap 150 foldably connected to the top end 114 of the first sidewall 132, and the first sidewall bottom flap 165 is foldably connected to the bottom end 116 of the first sidewall 132. The second sidewall 134 includes a second sidewall top flap 152 foldably connected to the top end 114 of the second sidewall 134, and the second sidewall bottom flap 168 foldably connected to the bottom 116 of the second sidewall 134. The second sidewall bottom flap extension 169 is foldably connected to the second sidewall bottom flap 168 opposite the second sidewall 134.

Still referring to FIG. 2, the front sidewall 136 is foldably connected to the second sidewall 134 opposite the first sidewall 132. The front sidewall 136 includes a top panel 160 foldably connected to the top end 114 of the top panel 160. The front sidewall 136 also includes a bottom panel 170 foldably connected to the bottom end 116 of the front sidewall 136. The top panel 160 includes an aperture 124 preferably location adjacent the front sidewall 136, and a top panel first flap 162 and top panel second flap 164 foldably connected to the top panel 160 adjacent the bottom end 116 of the top panel 160. The third sidewall 138 is foldably connected to the front panel 136 opposite the second sidewall 134. The third sidewall 138 includes a third sidewall top flap 156 foldably connected to the top end 114 of the third sidewall 138, and a third sidewall flap 166 foldably connected to the bottom end 116 of the third sidewall 138.

Still referring to FIG. 2, the fourth sidewall 140 is foldably connected to the third sidewall 138 opposite the front panel 136, and the inner sidewall 142 is foldably connected to the fourth sidewall 140 opposite the third sidewall 138. The fourth sidewall 140 includes a fourth sidewall top flap 154 foldably connected to the top end 114 of the fourth sidewall 140, and a fourth sidewall bottom flap 172 foldably connected to the bottom end 116 of the fourth sidewall 140. A fourth sidewall bottom flap extension 174 is foldably connected to the fourth sidewall bottom flap 172, opposite the fourth sidewall 140. The inner sidewall 142 includes inner sidewall stops 143 on the top end 114 of the inner sidewall 142, and an inner bottom support panel 130 is foldably connected to the bottom end 116 of the inner sidewall 142. Lastly, the inner sidewall flap 144 is foldably connected to the inner sidewall 142 opposite the fourth sidewall 140. The outer surface of the inner sidewall flap 144 includes an inner sidewall adhesive area 146 (FIG. 3).

Figure 3:
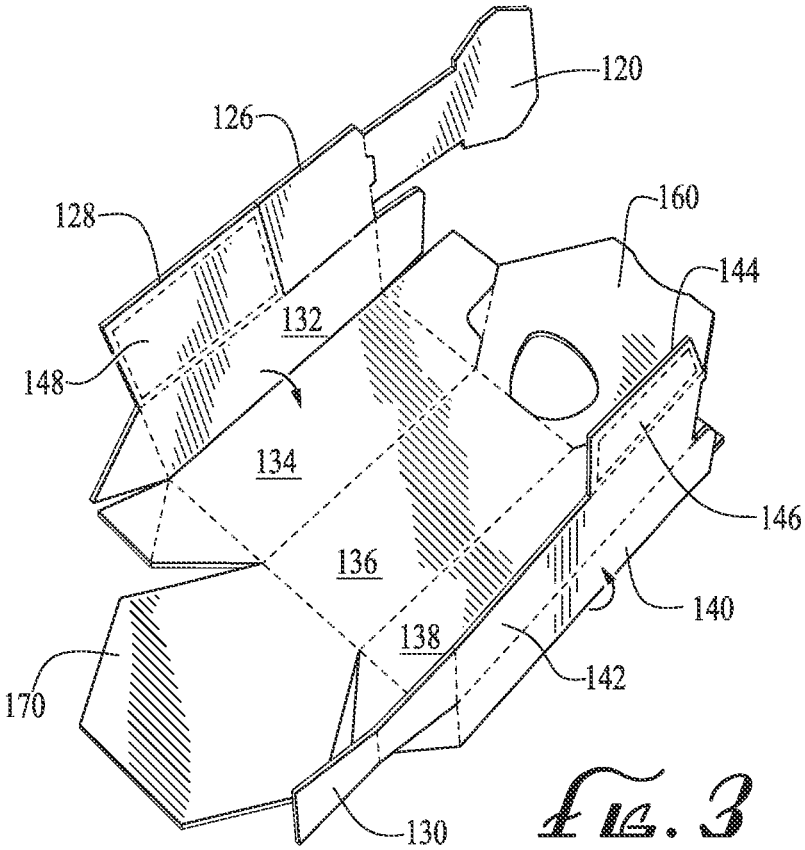
FIG. 3 is a perspective view of the cardboard blank of the first embodiment showing a first assembly step toward forming the hexagonal box with slide opening.

Now referring to FIG. 3, a first assembly step of forming the hexagonal box 100 (FIG. 13) may be folding the fourth sidewall 140 and first sidewall 132 at substantially ninety degrees towards the front sidewall 136 as shown by the arrows in FIG. 3.

Figures 4, 5:
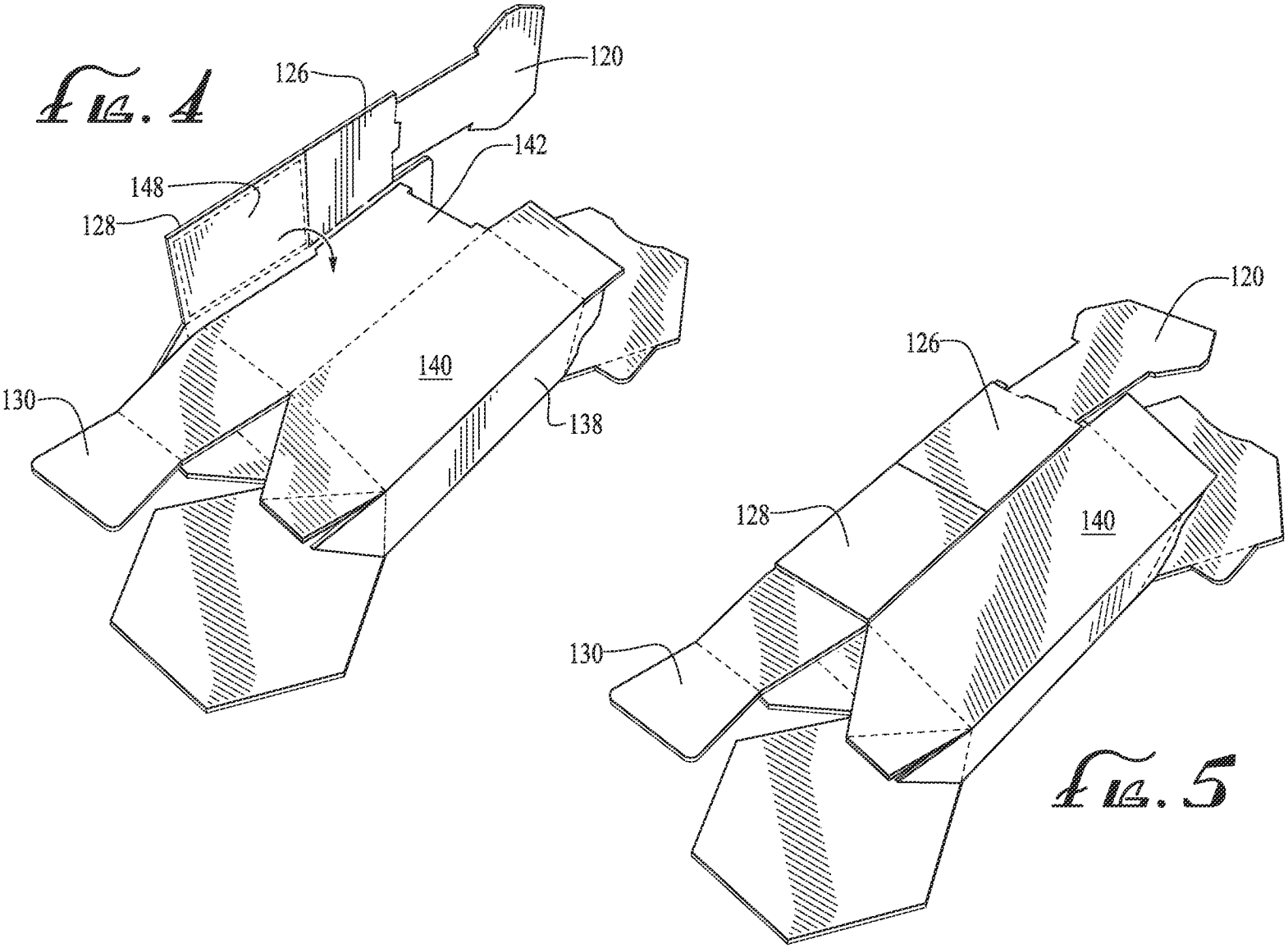
FIG. 4 is a perspective view of the cardboard blank of the first embodiment showing a second assembly step toward forming the hexagonal box with slide opening.
FIG. 5 is a perspective view of the cardboard blank of the first embodiment showing a third assembly step toward forming the hexagonal box with slide opening.

Referring now to FIG. 4, the third sidewall 138, the fourth sidewall 140 and inner sidewall 142 are folded over the front sidewall 136 (not shown), and the inner sidewall flap 144 (not shown) is folded at substantially ninety degrees. As shown by the arrow in FIG. 4, a next assembly step may be folding the back sidewall 128 such that the back sidewall adhesive area 148 contacts the inner sidewall 142, adhesively connected the back sidewall 128 to the inner sidewall 142. In this configuration, the inner sidewall adhesive area 146 (not shown) contacts the first sidewall 132 (now shown) such that the inner sidewall flap 144 adhesively connects to the first sidewall 132.

Referring to FIG. 5, the back sidewall 128 is adhesively connected to the inner sidewall 142 (not shown) and actuation sidewall 126.

Figure 6:
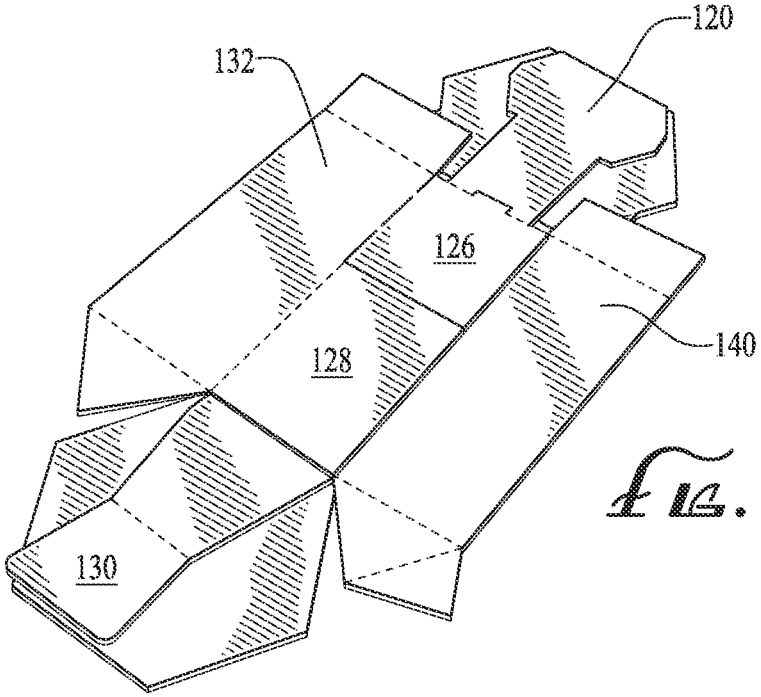
FIG. 6 is a perspective view of the partially-assembled hexagonal box of the first embodiment flattened for storage until filling and complete assembly of the box.

FIG. 6 illustrates the hexagonal box 100 (FIG. 13) in a partially assembled and flattened configuration, preferred for storage after assembly but prior to being filled.

Figure 7:
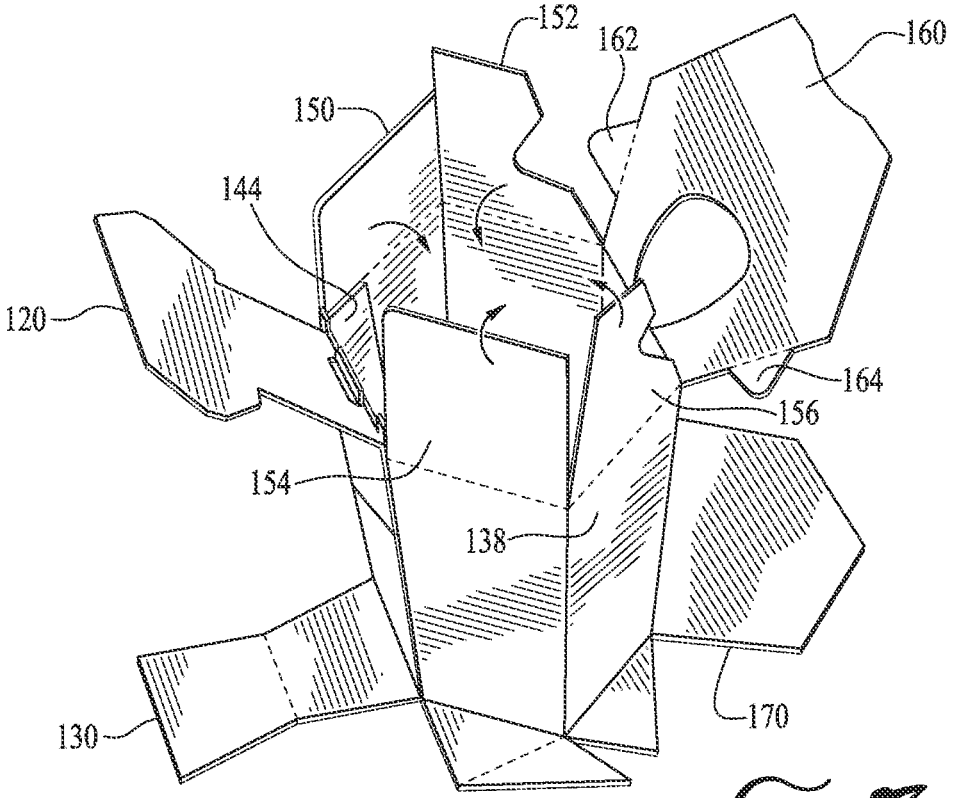
FIG. 7 shows a perspective view of the cardboard blank of the first embodiment showing a fourth assembly step toward forming the hexagonal box with slide opening.
Figure 8:
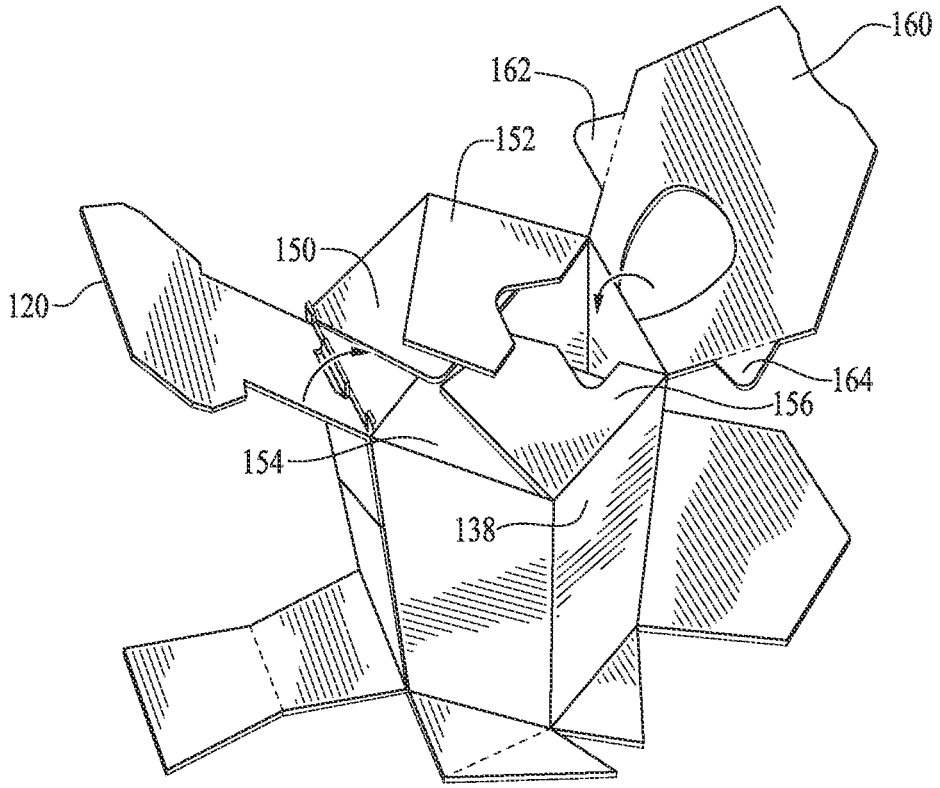
FIG. 8 shows a perspective view of the cardboard blank of the first embodiment showing a fifth assembly step toward forming the hexagonal box with slide opening.
Figure 9:
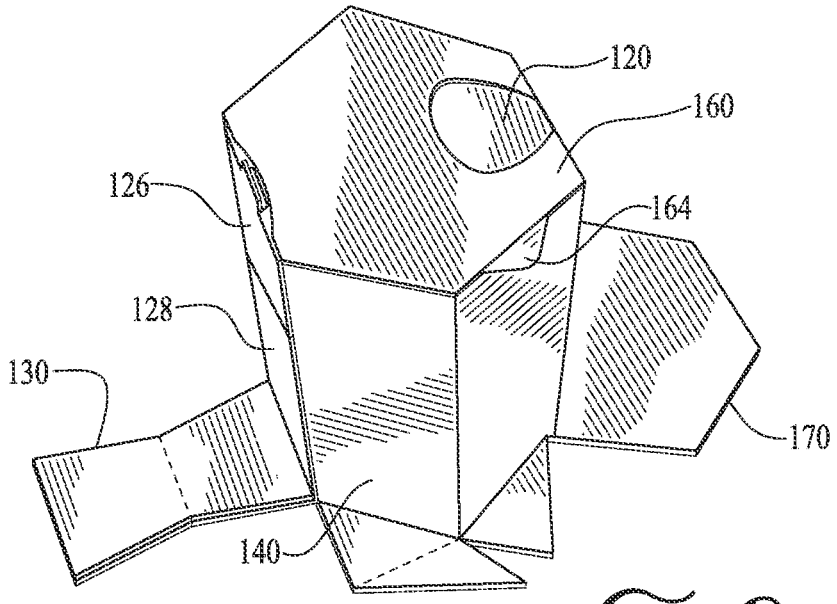
FIG. 9 is a perspective view of the cardboard blank of the first embodiment showing a sixth assembly step toward forming the hexagonal box with slide opening.

As shown by the arrows in FIG. 7, a next assembly step may be folding the first sidewall top flap 150, a second sidewall top flap 152, fourth sidewall flap 154, and third sidewall top flap 156 substantially ninety degrees towards the interior of the partially formed hexagonal box 100 (FIG. 13). As seen in FIGS. 8-9, the second sidewall top flap 152 is preferably folded over the first sidewall top flap 150, and the third sidewall top flap 156 is preferably folded over the fourth sidewall top flap 154. As shown by the arrows in FIG. 8, a next assembly step may be folding the slide 120 substantially ninety degrees towards the interior of the partially formed hexagonal box 100 (FIG. 13), folding the top panel 160 substantially ninety degrees over the slide 120, folding the top panel first flap 162 substantially ninety degrees to adhesively connect to the second sidewall 134 (not shown), and folding the top panel second flap 164 substantially ninety degrees to adhesively connect to the third sidewall 138. FIG. 9 illustrates completion of the assembly step.

Figure 10:
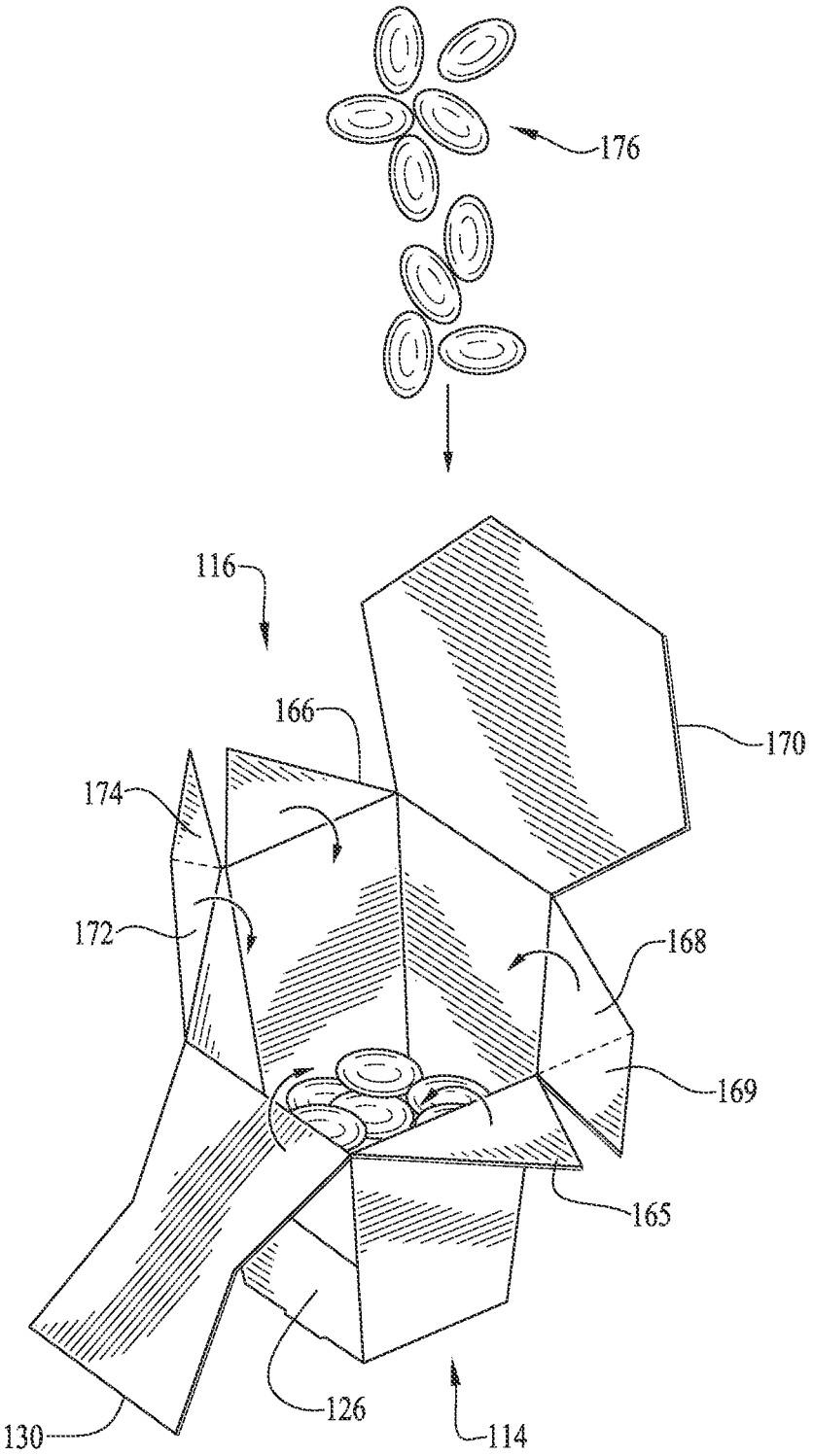
FIG. 10 is a perspective view of candy or other small pieces of food loaded into the bottom of the partially assembled box showing a seventh assembly step toward forming the hexagonal box with slide opening.

FIG. 10 illustrates the filling process, placing the partially formed hexagonal box 100 (FIG. 13) with the bottom end 116 upright such that candy or small food pieces may 176 be placed into the box 100 through the opened bottom end 116. As shown by the arrows in FIG. 10, the next assembly steps may include folding the first sidewall bottom flap 165, second sidewall bottom flap 168, third sidewall bottom flap 166, fourth sidewall bottom flap 172, and inner bottom support panel 130 substantially at ninety degrees toward the interior of the partially formed hexagonal box 100.

Figure 11:
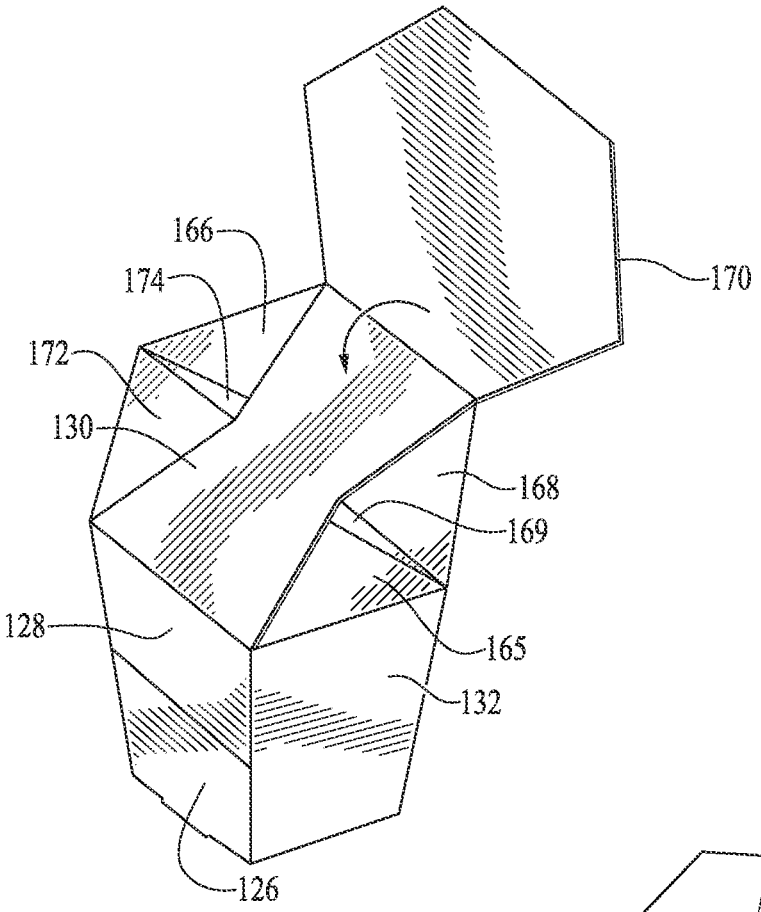
FIG. 11 is a perspective view of a bottom of the partially assembled hexagonal box, showing a final assembly step.
Figure 12:
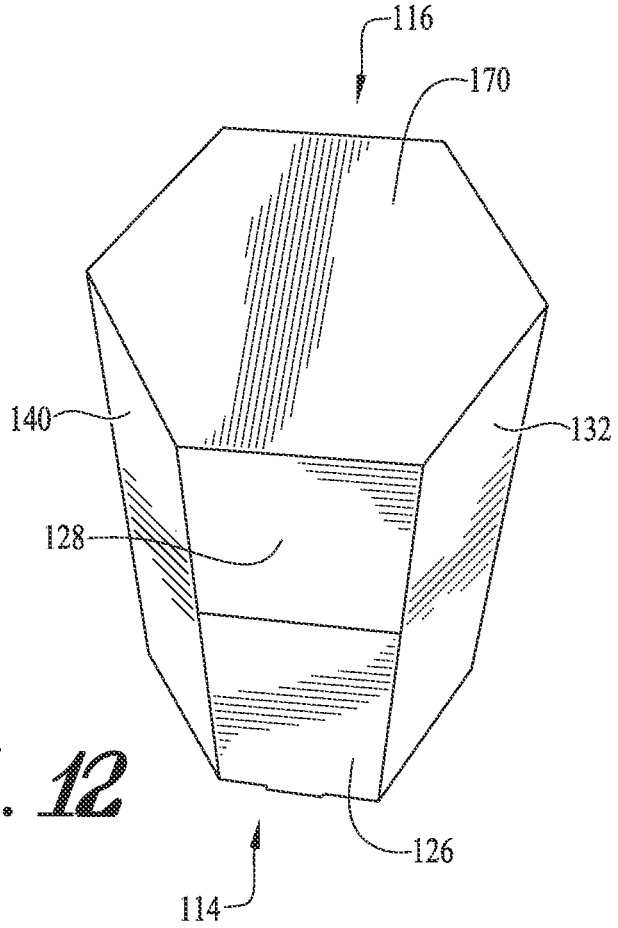
FIG. 12 shows the bottom of the assembled box.

FIG. 11 shows the inner bottom support panel 130 adjacent the first sidewall bottom flap 165, second sidewall bottom flap 168, second sidewall bottom flap extension 169, third sidewall bottom flap 166, fourth sidewall bottom flap 172 and fourth sidewall bottom flap extension 174. In this configuration, the third sidewall bottom flap 166 is preferably folded over a portion of the fourth sidewall bottom flap extension 174, and the first sidewall bottom flap 165 is preferably folded over a portion of the second sidewall bottom flap 168. As shown by the arrows in FIG. 11, a final assembly step may be a one-step, automatic closure achieved by folding the bottom panel 170 substantially ninety degrees and adhesively connected to the inner bottom support panel 130, first sidewall bottom flap 165, second sidewall bottom flap 168, second sidewall bottom flap extension 169, third sidewall bottom flap 166, fourth sidewall bottom flap 172 and fourth sidewall bottom flap extension 174. As seen in FIG. 12, structural integrity is achieved because the bottom panel 170 adhesively connects to extensions of the first sidewall 132 (the first sidewall bottom flap 165), second sidewall 134 (not shown) (the second sidewall bottom flap 168 and second sidewall bottom flap extension 169), third sidewall 138 (the third side wall bottom flap 166), fourth sidewall 140 (the fourth sidewall bottom flap 172 and fourth sidewall bottom flap extension 174), and inner sidewall 142 (not shown) (the inner bottom support panel 130).

Figure 14:
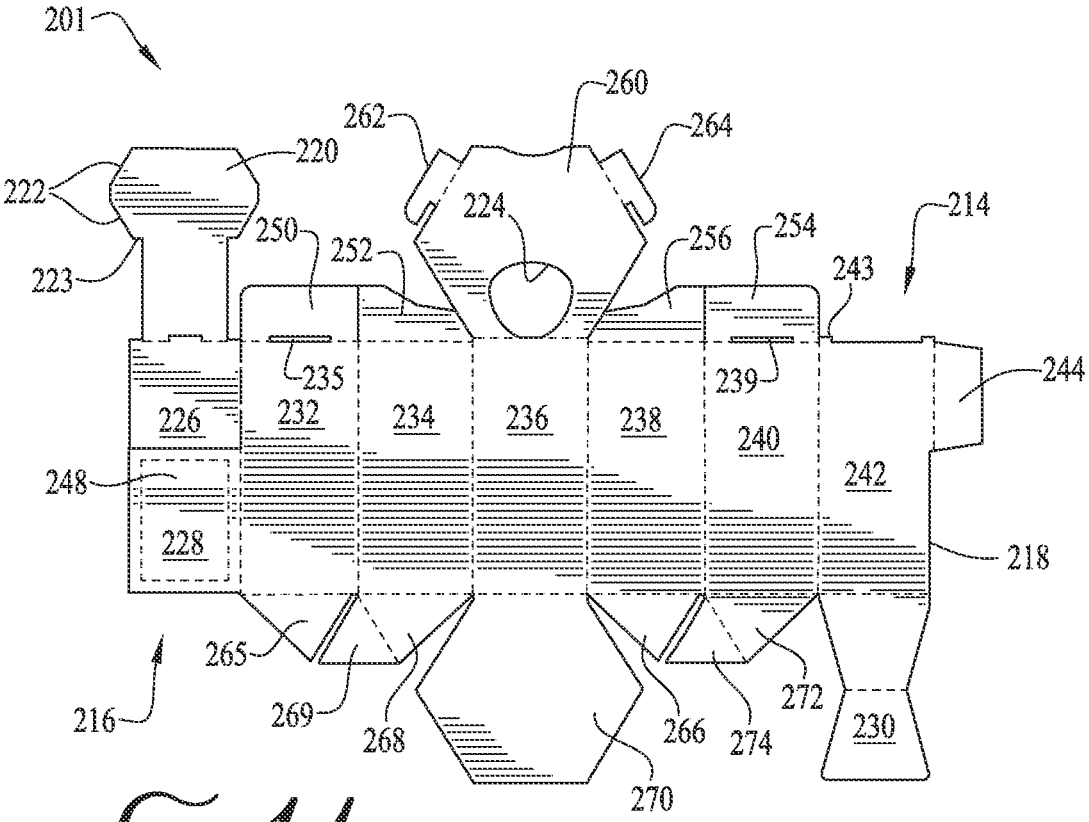
FIG. 14 is a flat pattern view of the cardboard or paperboard blank of a second embodiment which can be folded to form the hexagonal container or box with slide opening.
Figure 19:
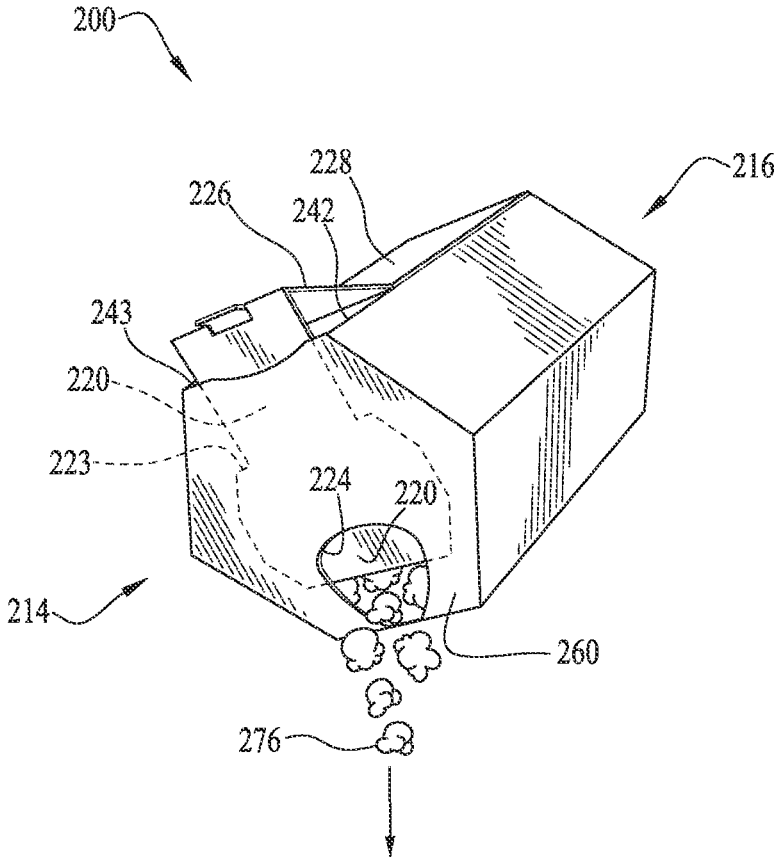
FIG. 19 is a perspective view of the second embodiment of the assembled box dispensing popcorn or other small pieces of food or candy.

FIG. 14 illustrates a second embodiment of a die cut paper or cardboard blank 201 used to form the box 200 (FIG. 19). The second embodiment is designed for manual (as opposed to automated utilizing machines) closing of the box 200. The cardboard blank 201 has a top end 214 and a bottom end 216 and is scored for folding such that the box 200 is a hexagonal shape. Major portions of the cardboard blank 201 include a front sidewall 236, back sidewall 228, inner sidewall 242, first sidewall 232, second sidewall 234, third sidewall 238, fourth sidewall 240, top panel 260, bottom panel 270 and slide 220.

Still referring to FIG. 14, an actuation sidewall 226 is foldably connected to the back sidewall 228, and the slide 220 is foldably connected to the actuation sidewall 226 opposite the back sidewall 228. The back sidewall 228 includes a back sidewall adhesive area 248. The slide 220 includes angled stop portions 222 adjacent the top end 214 of the slide 220, and slide stops 223 adjacent the angled stop portions 222. The first sidewall 232 is foldably connected to the back sidewall 228, and the second sidewall 234 is foldably connected to the first sidewall 232 opposite the back sidewall 228. The first sidewall 232 includes a first sidewall top flap 250 foldably connected to the top end 214 of the first sidewall 232, and the first sidewall top flap 250 includes a first slit 235 adjacent the first sidewall 232. The first sidewall 232 also includes a first sidewall bottom flap 265 foldably connected to the bottom end 216 of the first sidewall 232. The second sidewall 234 includes a second sidewall top flap 252 foldably connected to the top end 214 of the second sidewall 234. The second sidewall 234 also includes a second sidewall bottom flap 268 foldably connected to the bottom end 216 of the second sidewall 234, and a second sidewall bottom flap extension 269 foldably connected to the second sidewall bottom flap 268 opposite the second sidewall 234.

Still referring to FIG. 14, the front sidewall 236 is foldably connected to the second sidewall 234 opposite the first sidewall 232. The top panel 260 is foldably connected to the top end 214 of the front sidewall 236 and includes an aperture 224 located preferably adjacent the top end 216 of the front sidewall 236, and a foldably connected top panel first flap 262 and top panel second flap 264 adjacent the top end 214, and on opposite sides, of the top panel 260. The front sidewall 236 also includes a bottom panel 270 foldably connected to bottom end 216 of the front sidewall 236. The third sidewall 238 is foldably connected to the front panel 236 opposite second sidewall 234, and includes a third sidewall top flap 256 foldably connected to the top end 214 of the third sidewall 238.

Still referring to FIG. 14, the fourth sidewall 240 is foldably connected to the third sidewall 238 opposite the front panel 236, and the inner sidewall 242 is foldably connected to the fourth sidewall 240 opposite the third sidewall 238. The fourth sidewall 240 includes a fourth sidewall top flap 245 foldably connected to the top end 214 of the fourth sidewall 240, and the fourth sidewall top flap 254 includes a second slit 239 adjacent the fourth sidewall 240. The fourth sidewall 240 also includes a fourth sidewall bottom flap 272 foldably connected to the bottom end 116 of the fourth sidewall 240, and a fourth sidewall bottom flap extension 274 is foldably connected to the fourth sidewall bottom flap 272 opposite the fourth sidewall 240. The inner sidewall 242 includes inner sidewall stops 243 on the top end 214 of the inner sidewall 242, and an inner bottom support panel 230 foldably connected to the bottom end 216 of the inner sidewall 242. Lastly, the inner sidewall flap 244 is foldably connected to the inner sidewall 242 opposite the fourth sidewall 240. The outer surface of inner sidewall flap 244 includes an inner sidewall adhesive area 246 (similar to FIG. 3).

Similar to assembly of the first embodiment of the hexagonal box 100, a first assembly step of forming the second embodiment of the hexagonal box 200 may be folding the fourth sidewall 240 and first sidewall 232 at substantially ninety degrees towards the front sidewall 236. (See FIG. 3). A second assembly step may be folding the third sidewall 238, fourth sidewall 240, the inner sidewall 242 over the front sidewall 236, and folding the inner sidewall flap 244 at substantially ninety degrees. (See FIG. 4). A third assembly step may be folding the back sidewall 228 such that the back sidewall adhesive area 248 contacts the inner sidewall 242 such that the back sidewall 228 and inner sidewall 242 are adhesively connected. (See FIG. 5). In this configuration, the inner sidewall adhesive area 246 contacts the first sidewall 232 such that the inner sidewall flap 244 adhesively connects to the first sidewall 232, and the back sidewall 228 is adhesively connected to the inner sidewall 242. (See FIG. 5).

Figure 15:
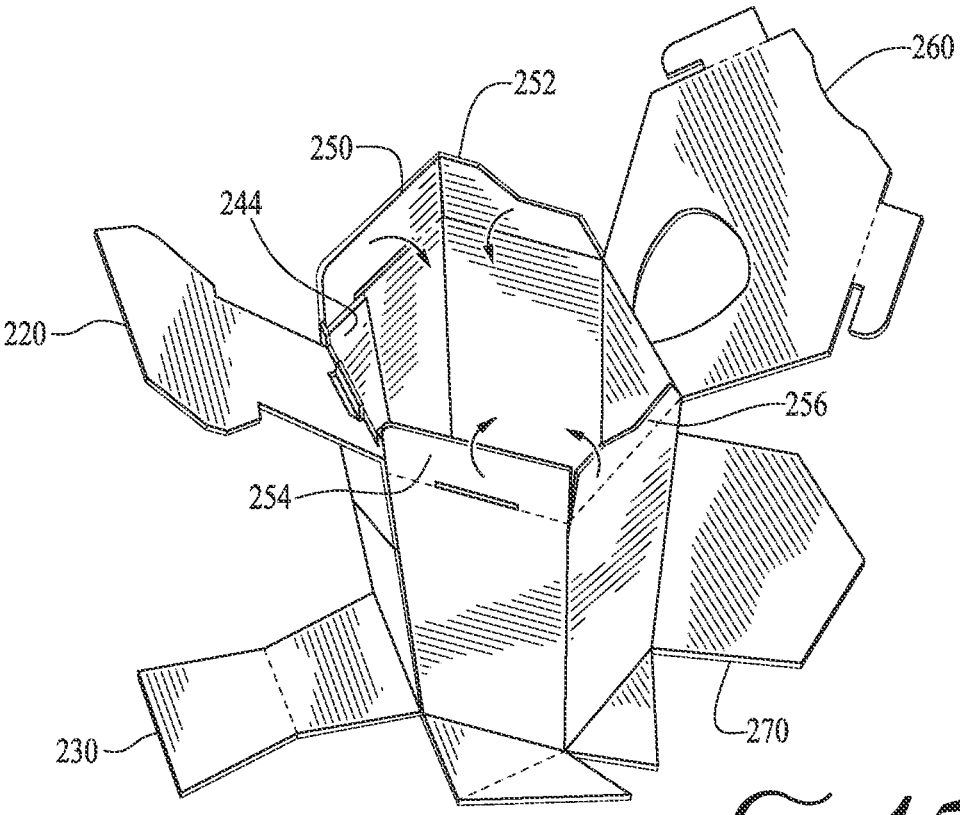
FIG. 15 shows a perspective view of the cardboard blank of the second embodiment showing a fourth assembly step toward forming the hexagonal box with slide opening.
Figure 16:
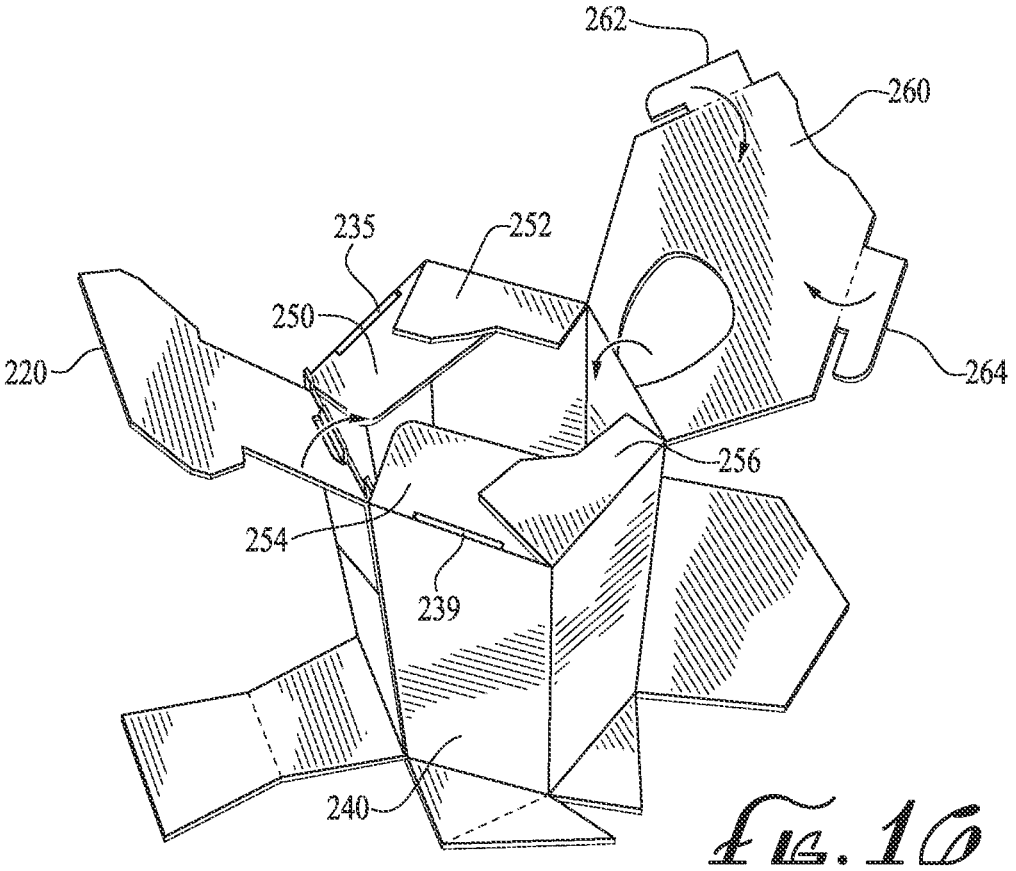
FIG. 16 shows a perspective view of the cardboard blank of the second embodiment showing a fifth assembly step toward forming the hexagonal box with slide opening.
Figure 17:
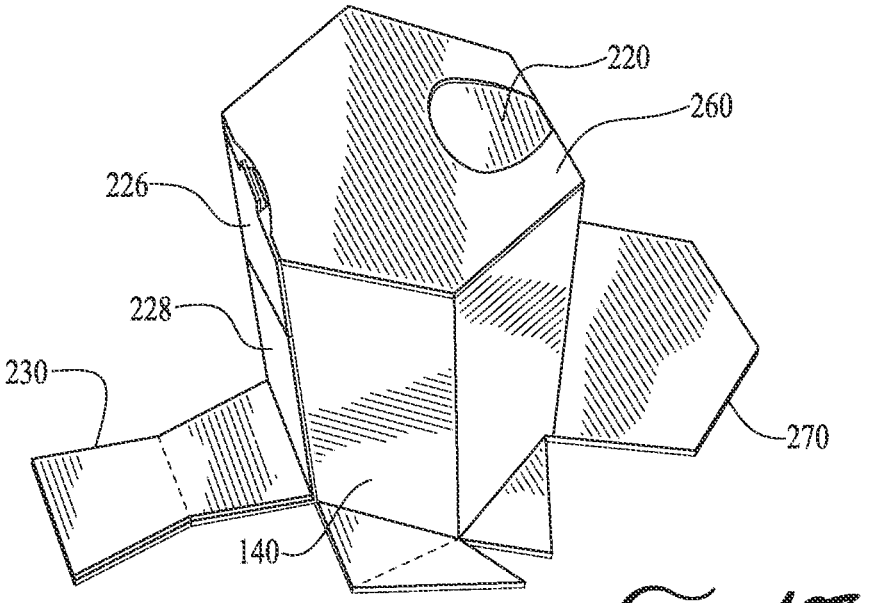
FIG. 17 is a perspective view of the cardboard blank of the second embodiment showing a sixth assembly step toward forming the hexagonal box with slide opening.

As shown by the arrows in FIG. 15, a next assembly step may be folding the first sidewall top flap 250, a second sidewall top flap 252, third sidewall top flap 256, and fourth sidewall top flap 254 substantially ninety degrees towards the interior of the partially formed hexagonal box 200 (FIG. 19). As shown by the arrows in FIG. 16, a next assembly step may be folding the slide 220 substantially ninety degrees towards the interior of the partially formed hexagonal box 200 and folding the top panel 260 substantially ninety degrees and above the slide 120. In this configuration, the top panel first flap 262 and top panel second flap 264 are folded at substantially ninety degrees and insert within the first slit 235 and second slit 239, respectively. FIG. 17 illustrates completion of the assembly step.

Figure 18:
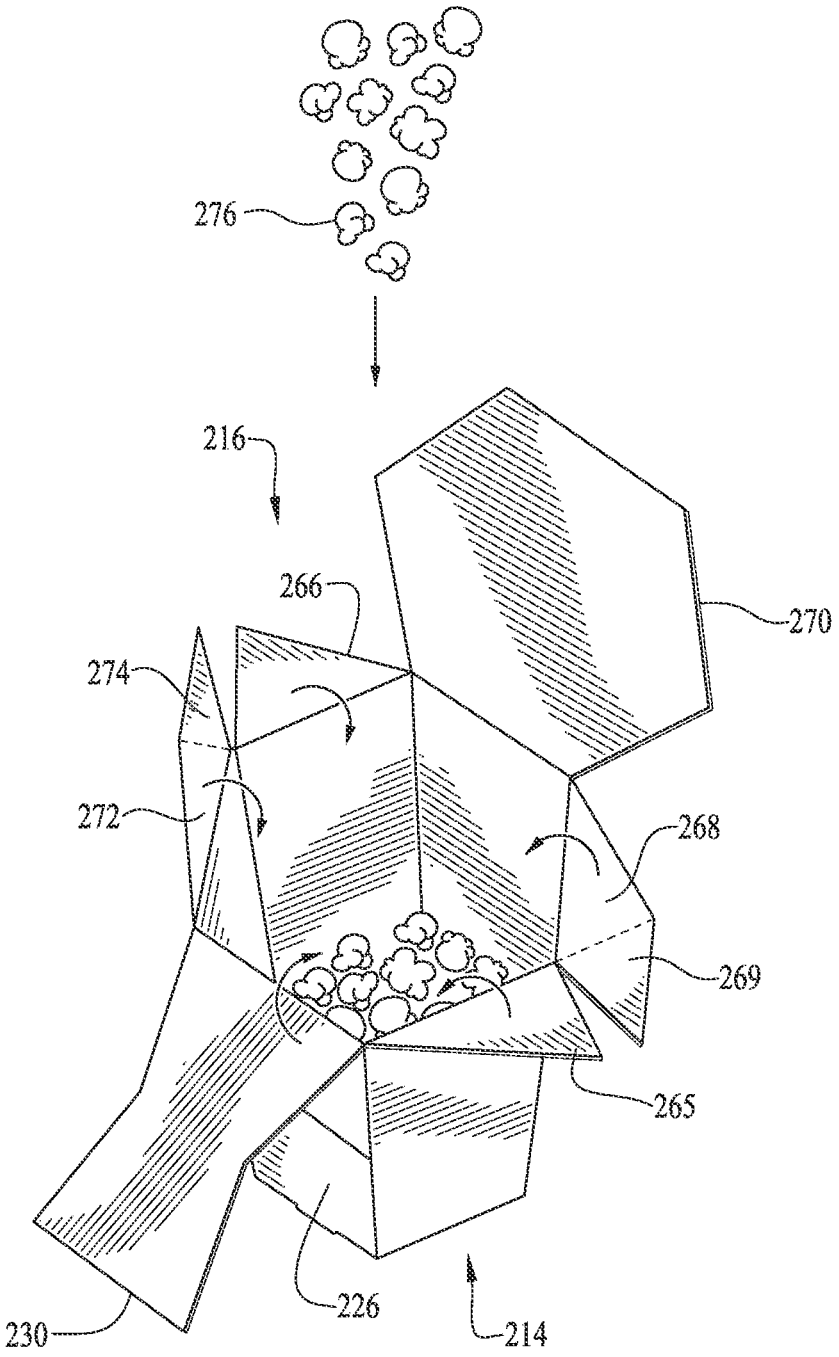
FIG. 18 is a perspective view of popcorn other small pieces of food or candy loaded into the bottom of the partially assembled box and showing a seventh assembly step toward forming the second embodiment of the hexagonal box with slide opening.

FIG. 18 illustrates the filling process, placing the partially formed hexagonal box 200 (FIG. 19) with the bottom end 216 upright such that popcorn or small food pieces of food 276 may be placed into the box 200 through the opened bottom end 116. As shown by the arrows in FIG. 18, the next assembly steps may include folding the first sidewall bottom flap 265, second sidewall bottom flap 268, third sidewall bottom flap 266, fourth sidewall bottom flap 272, and inner bottom support panel 230 substantially at ninety degrees towards the interior of the partially formed hexagonal box 200. Similar to the first embodiment of the hexagonal box 100, a final assembly step may be a one-step, automatic closure achieved by the folding bottom support panel 270 substantially ninety degrees and adhesively connecting to the inner bottom support panel 230, first sidewall bottom flap 265, second sidewall bottom flap 268, second sidewall bottom flap extension 269, third sidewall bottom flap 266, fourth sidewall bottom flap 272 and fourth sidewall bottom flap extension 274.

FIG. 19 shows the assembled hexagonal box 200. The slide 220 is laterally moved away from the top panel 260 to open the aperture 224 and dispense popcorn or other small pieces of food 276.

Optionally, the bottom end 216 of the second embodiment can be glued and closed first, following the steps outlined above. This allows the second embodiment to be filled through the open top end 214 (as opposed to the open bottom end 216 shown in the FIGS.). Once the second embodiment is filled through the open top end 214, the open top end 214 can then be closed and sealed as discussed above.

Figure 20:
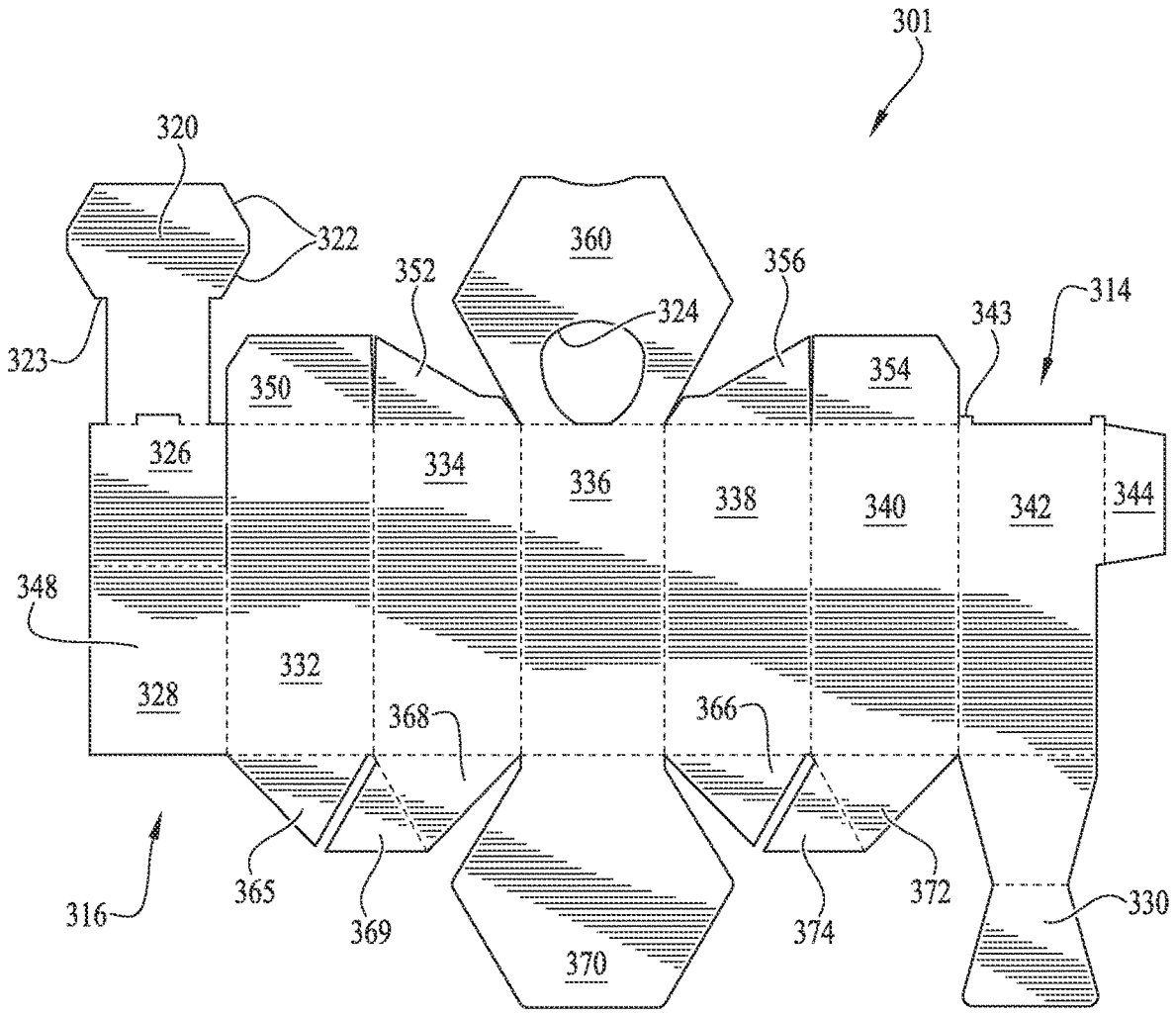
FIG. 20 is a flat pattern view of the cardboard or paperboard blank of a third embodiment which can be folded to form the hexagonal container or box with slide opening.
Figure 27:
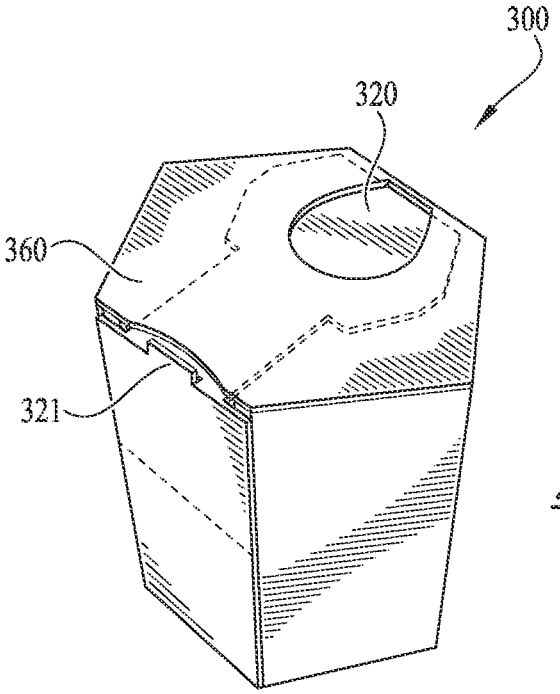
FIG. 27 is a perspective view of the cardboard blank of the third embodiment showing a tenth assembly step toward forming the hexagonal box with slide opening.

FIG. 20 illustrates a third embodiment of a die cut paper or cardboard blank 301 used to form the box 300 (FIG. 27). The cardboard blank 301 has a top end 314 and a bottom end 316 and is scored for folding such that the box 300 is a hexagonal shape. Major portions of the cardboard blank 301 include a front sidewall 326, back sidewall 328, inner sidewall 342, first sidewall 332, second sidewall 334, third sidewall 338, fourth sidewall 340, top panel 360, bottom panel 370 and slide 320.

Still referring to FIG. 20, an actuation sidewall 326 is foldably connected to the back sidewall 328, and the slide 320 is foldably connected to the actuation sidewall 326 opposite the back sidewall 328. The back sidewall 328 includes a back sidewall adhesive area 348. The slide 320 includes angled stop portions 322 adjacent the top end 314 of the slide 320, and slide stops 323 adjacent the angled stop portions 322. The first sidewall 332 is foldably connected to the back sidewall 328, and the second sidewall 334 is foldably connected to the first sidewall 332 opposite the back sidewall 328. The first sidewall 332 includes a first sidewall top flap 350 foldably connected to the top end 314 of the first sidewall 332. The first sidewall 332 also includes a first sidewall bottom flap 365 foldably connected to the bottom end 316 of the first sidewall 332. The second sidewall 334 includes a second sidewall top flap 352 foldably connected to the top end 314 of the second sidewall 334. The second sidewall 334 also includes a second sidewall bottom flap 368 foldably connected to the bottom end 316 of the second sidewall 334, and a second sidewall bottom flap extension 369 foldably connected to the second sidewall bottom flap 368 opposite the second sidewall 334.

Still referring to FIG. 20, the front sidewall 336 is foldably connected to the second sidewall 334 opposite the first sidewall 332. The top panel 360 is foldably connected to the top end 314 of the front sidewall 336 and includes an aperture 324 located preferably adjacent the top end 316 of the front sidewall 336. The front sidewall 336 also includes a bottom panel 370 foldably connected to bottom end 316 of the front sidewall 336. The third sidewall 338 is foldably connected to the front sidewall 336 opposite second sidewall 334, and includes a third sidewall top flap 356 foldably connected to the top end 314 of the third sidewall 338.

Still referring to FIG. 20, the fourth sidewall 340 is foldably connected to the third sidewall 338 opposite the front panel 336, and the inner sidewall 342 is foldably connected to the fourth sidewall 340 opposite the third sidewall 338. The fourth sidewall 340 includes a fourth sidewall top flap 354 foldably connected to the top end 314 of the fourth sidewall 340. The fourth sidewall 340 also includes a fourth sidewall bottom flap 372 foldably connected to the bottom end 316 of the fourth sidewall 340, and a fourth sidewall bottom flap extension 374 is foldably connected to the fourth sidewall bottom flap 372 opposite the fourth sidewall 340. The inner sidewall 342 includes inner sidewall stops 343 on the top end 314 of the inner sidewall 342, and an inner bottom support panel 330 foldably connected to the bottom end 316 of the inner sidewall 342. Lastly, the inner sidewall flap 344 is foldably connected to the inner sidewall 342 opposite the fourth sidewall 340. The outer surface of inner sidewall flap 344 includes an inner sidewall adhesive area 346 (similar to FIG. 3).

Similar to assembly of the first embodiment of the hexagonal box 100, a first assembly step of forming the third embodiment of the hexagonal box 300 may be folding the fourth sidewall 340 and the first sidewall 332 at substantially ninety degrees towards the front sidewall 336. (See FIG. 3). A second assembly step may be folding the third sidewall 338 and the fourth sidewall 340, and then folding the inner sidewall 342 over the front sidewall 336, and then folding the inner sidewall flap 344 at substantially ninety degrees. (See FIG. 4). A third assembly step may be folding the back sidewall 328 such that the back sidewall adhesive area 348 contacts the inner sidewall 342 such that the back sidewall 328 and inner sidewall 342 are adhesively connected. (See FIG. 5). In this configuration, the inner sidewall adhesive area 346 contacts the first sidewall 332 such that the inner sidewall flap 344 adhesively connects to the first sidewall 332, and the back sidewall 328 is adhesively connected to the inner sidewall 342. (See FIG. 5).

Figure 21:
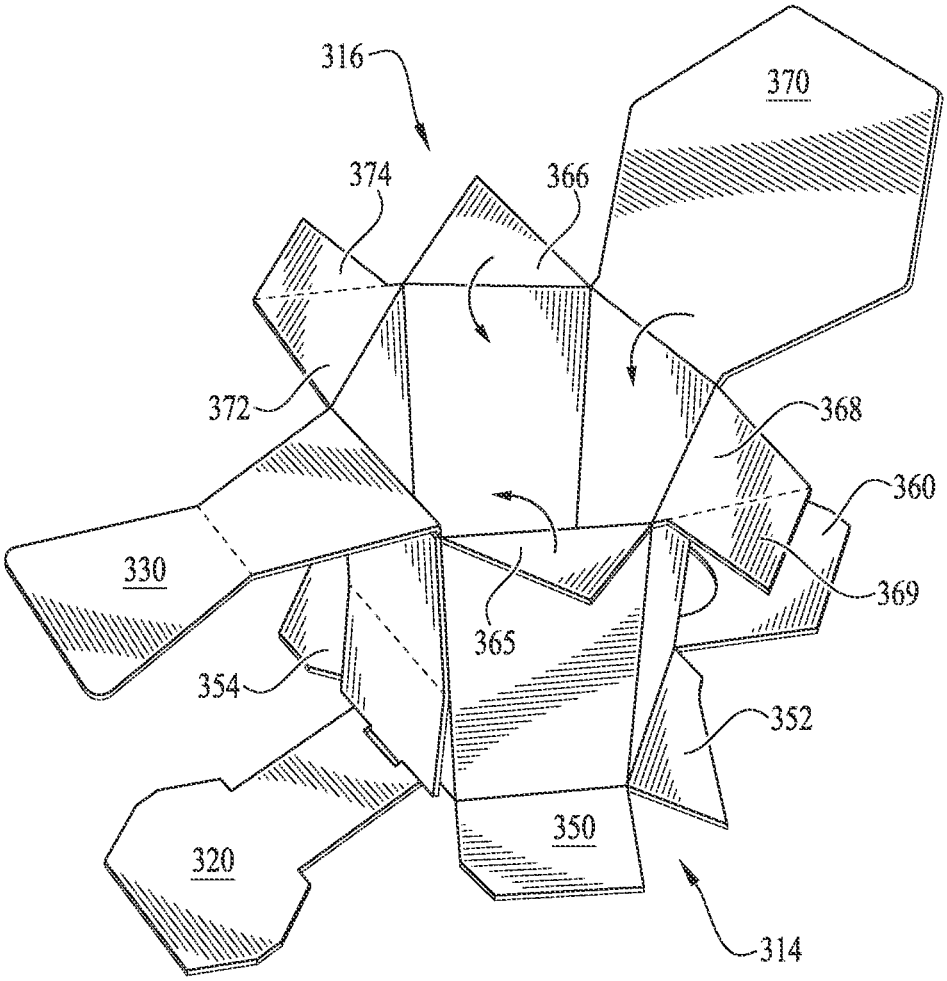
FIG. 21 shows a perspective view of the cardboard blank of the third embodiment showing a fourth assembly step toward forming the hexagonal box with slide opening.
Figure 22:
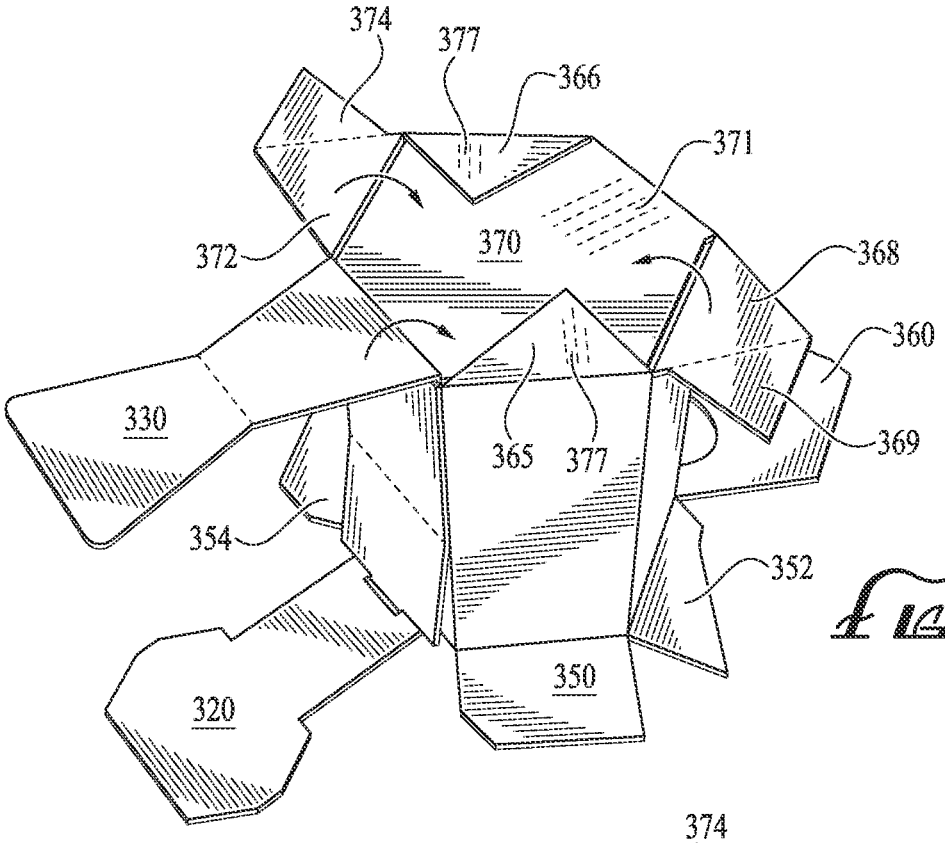
FIG. 22 shows a perspective view of the cardboard blank of the third embodiment showing a fifth assembly step toward forming the hexagonal box with slide opening.

As shown by the arrows in FIGS. 21 and 22, the next assembly steps may include first folding the hexagonal shaped bottom panel 370 substantially at ninety degrees toward the interior of the partially formed hexagonal box 300, then the folding first sidewall bottom flap 365 and the third sidewall bottom flap 366 on top of the bottom panel 370, then folding the second sidewall bottom flap 368 and the fourth sidewall bottom flap 372 such that fourth sidewall bottom flap extension 374 overlaps at least a portion of the third sidewall bottom flap 366 and the second sidewall bottom flap extension 369 overlaps at least a portion of the first sidewall bottom flap 365. The fourth sidewall bottom flap extension 374 is then glued to the third sidewall bottom flap 366 and the second sidewall bottom flap extension 369 is glued to the first sidewall bottom flap 365 using adhesive areas 377.

The hexagonal shape of the bottom panel 370 is important for several reasons. First, due to the positioning of panel 370 within the partially formed box 300 once panel 370 has been folded, panel 370 provides support from the inside of the box 300 to keep the box 300 in its hexagonal form. This is important because the structural support that panel 370 provides allows the packaging machine to pick up the partially formed box 300 in order to complete the form and fill process. Second, panel 370 also forms the base upon which tabs 365, 366 are glued to. This makes the box 300 very efficient from the standpoint of the form and fill machine. And third, panel 370 allows all of the sidewalls, flaps and tabs of the box 300 to be properly aligned due to the hexagonal shape of the 370. FIG. 22 shows this alignment, wherein panel 370 is inside the partially formed box 300 and.

Figure 23:
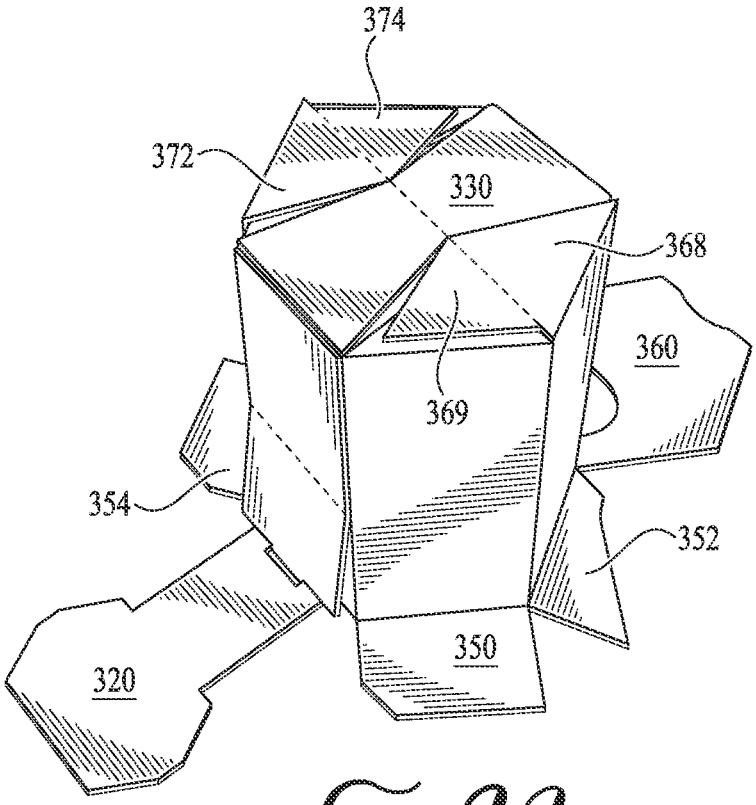
FIG. 23 is a perspective view of the cardboard blank of the third embodiment showing a sixth assembly step toward forming the hexagonal box with slide opening.

FIG. 23 shows the folding of the inner bottom support panel 330 onto the folded bottom panel 370. Inner bottom support panel 330 is then glued to bottom panel 370 using adhesive area 371, achieving structural integrity.

Figure 24:
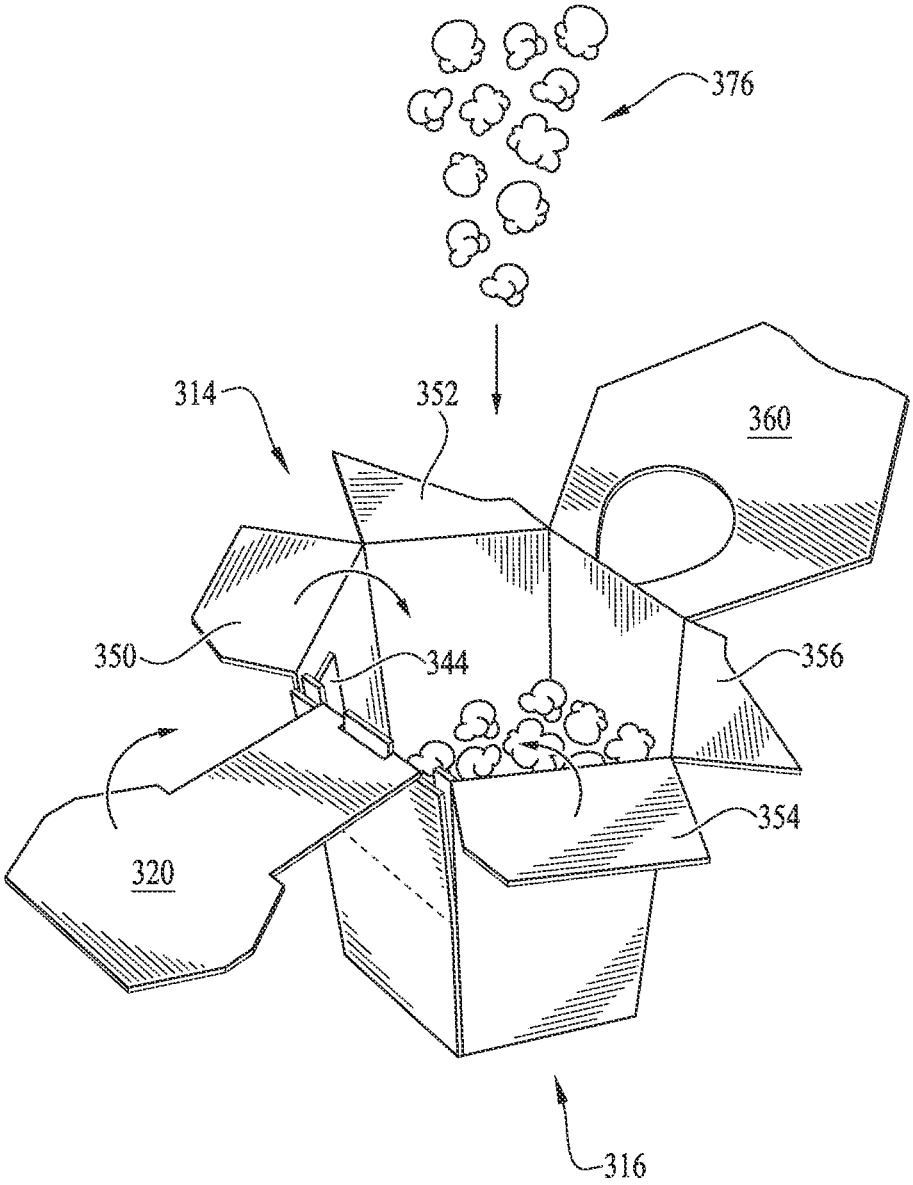
FIG. 24 is a perspective view of popcorn other small pieces of food or candy loaded into the bottom of the partially assembled box and showing a seventh assembly step toward forming the third embodiment of the hexagonal box with slide opening.

FIG. 24 illustrates the filling process, wherein the partially formed box 300 is oriented up-right, such that the bottom 316 of the partially formed box 300 is formed and sealed, and the top end 314 is up-right and open and configured for top loading. The top loading feature is important because the partially formed box 300 is already properly oriented in the form and fill machine for loading. If the box 300 required to be loaded from the bottom, the form and fill machine would have to change the orientation of the box 300 to fill it. This change in orientation is not efficient, or even practical, in the real world of mass-manufacturing.

In the filling process illustrated in FIG. 24, dispensing products, including but not limited to, candies, pharmaceutical products, or small food pieces may 376 be placed into the box 300 through the opened top end 314. Thus, boxes 100, 200 and 300 are not limited to use in the food industry, but can be used in any industry that requires a box to dispense a plurality of small items (dispensing products).

Figure 25:
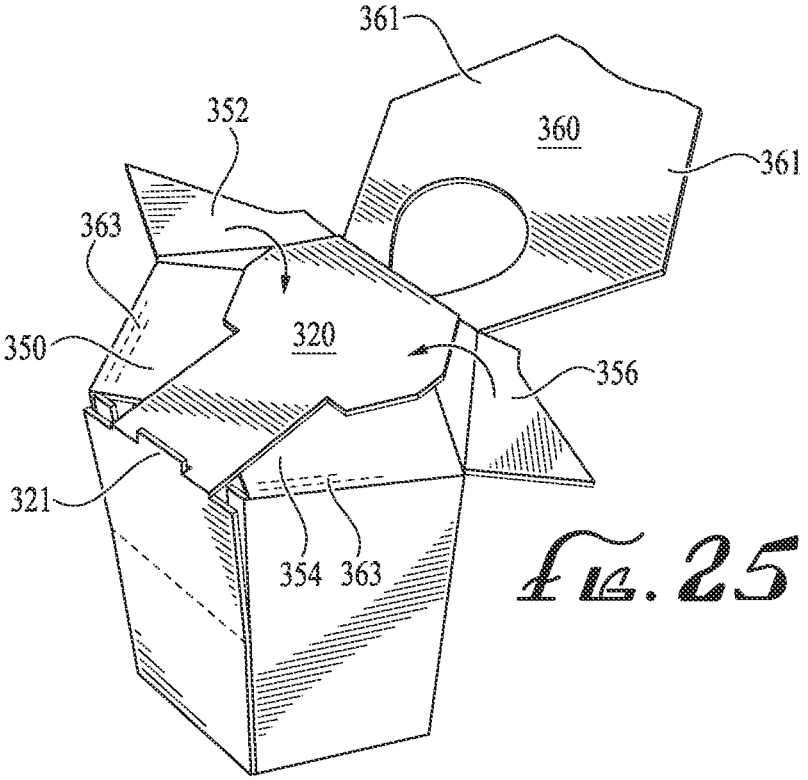
FIG. 25 is a perspective view of the cardboard blank of the third embodiment showing an eighth assembly step toward forming the hexagonal box with slide opening.
Figure 26:
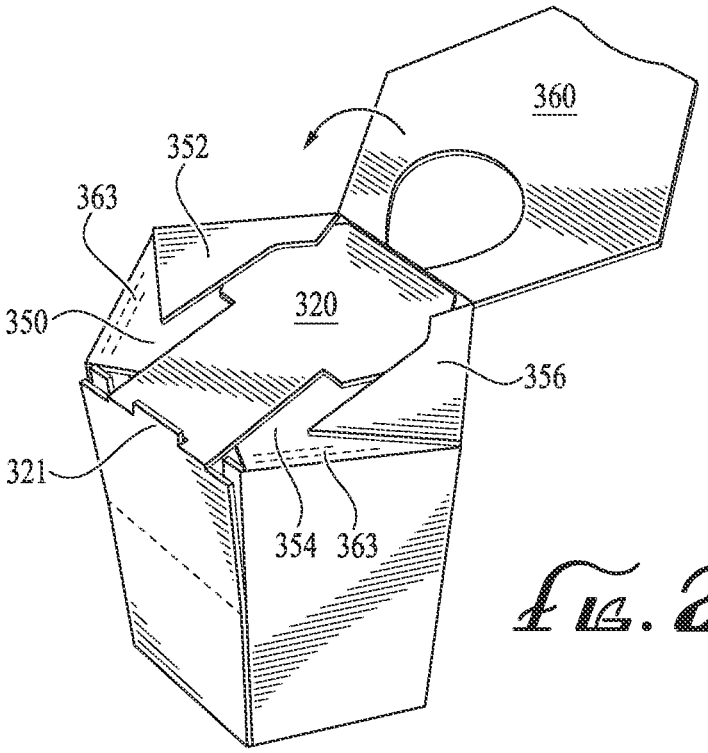
FIG. 26 is a perspective view of the cardboard blank of the third embodiment showing a ninth assembly step toward forming the hexagonal box with slide opening.

As shown by the arrows in FIGS. 24-26, a next assembly step may be folding the first sidewall top flap 350 and the fourth sidewall top flap 354 substantially ninety degrees towards the interior of the partially formed hexagonal box 300. As shown by the arrows in FIGS. 25 and 26, a next assembly step may be folding the slide 320 substantially ninety degrees towards the interior of the partially formed hexagonal box 300. Then, the second sidewall top flap 352 and the third sidewall top flap 356 are both folded substantially ninety degrees towards the interior of the partially formed hexagonal box 300. Flaps 352 and 356 function as a holding guide for slide 320. And finally, the top panel 360 is folded substantially ninety degrees such that edges 361 of top panel 360 are glued to adhesive areas 363 on the first sidewall top flap 350 and fourth sidewall top flap 354.

The folding of top flaps 350, 354, 352, and 356 are important because they align the open top end 314 of the box 300 with the formed hexagonal bottom 316. The top end 314 must be properly aligned so that top panel 360 is properly aligned and glued. As shown in the figures, slide 320 has a pull tab 321 for easy gripping by a user's finger. Pull tab 321 allows the user to pull and push slide 320 out of and into the box 300. The folding of top flaps 350, 354, 352, and 356 ensure that pull tab 321 is properly aligned to effect proper movement of slide 320.

This top flap folding configuration also provides the structural support necessary for the top dispensing mechanism (slide 320 and opening 324) to properly function. Slide 320 is positioned such that flaps 350 and 354 are below slide 320, and flaps 352 and 356 are above slide 320. Flaps 350 and 354 function as a base for supporting slide 320 and holding slide 320 up and against opening 324. Flaps 352 and 356 function as a holding guide for slide 320 to keep slide 320 straight when it gets slid in and out of the box 300. Without flaps 352 and 356, slide 320 would be able to move sideways and out of alignment with opening 324.

FIG. 27 illustrates completion of the assembly step, wherein top panel 360 and opening 324 are properly aligned with slide 320.

Figure 28:
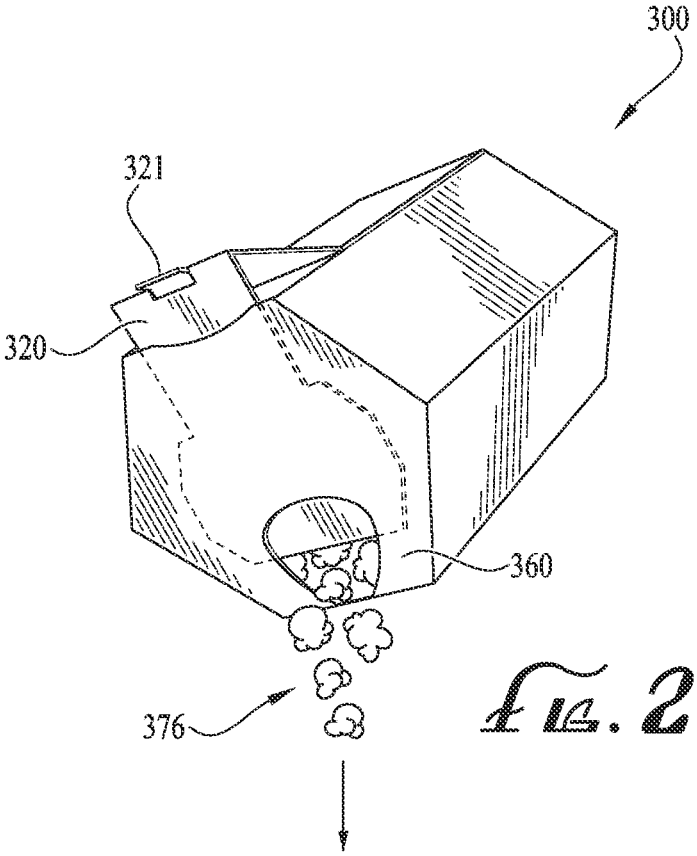
FIG. 28 is a perspective view of the third embodiment of the assembled box dispensing popcorn or other small pieces of food or candy.

FIG. 28 illustrates use of the assembled hexagonal box 300. The slide 220 is laterally moved away from the top panel 360 to open the aperture 324 and dispense popcorn or other dispensing products 376.

The box 100, 200, 300 of the present invention has the following advantages:

All three embodiments 100, 200, 300 have seal-ends, which is a notable advantage over Applicants prior applications: U.S. patent publication nos. 2005-0067476A1, 2006-0124709A1. Applicant's prior applications are not seal-end boxes, and seal-end boxes are necessary for use with standard seal-end form and fill machines used by most food and mass-manufacturers. Moreover, Applicant's prior applications truly were not feasible for use in the mass-production food industry. The configuration of the prior designs did not permit them to be used in standard seal-end form and fill machines. The prior design could not be held open in the hexagonal shape and glued and filled. It simply didn't work from a mass-production standpoint.

Notable differences between Applicant's prior applications and the embodiments of the present invention include removal of a plurality of glue tabs from the top and bottom panels in the blank designs in Applicant's prior applications to achieve the seal-end design of the embodiments of the present invention. The presence of the glue tabs in the prior applications required the mass-production machines to perform movements they are not designed to perform. And most food manufacturers are not going to modify the very expensive machines they already have to accommodate use of a new box. As such, it was necessary to modify the design of the hexagonal box so that it could be used with standard form and fill machines without any modification.

Other changes in design include removal of extra top panels and changes in the shape and configuration of the bottom flaps. Both of these changes contribute to the commercialability of the embodiments of the present invention.

The foregoing descriptions have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

Although a very narrow claim in presented herein, it should be recognized the scope of this invention is much broader than presented by the claim. It is intended that broader claims will be submitted in an application that claims the benefit of priority from the application.

Insofar as the description above and the accompanying drawings disclose any additional subject matter that is not within the scope of the single claim below, the inventions are not dedicated to the public and the right to file one or more applications to claim such additional inventions is reserved.

What is claimed is:

1. A blank used to form a hexagonal shaped box, the blank having:

a) a front sidewall and a back sidewall, wherein the front sidewall is foldably connected to the back sidewall;

b) a first sidewall foldably connected to the back sidewall;

c) a second sidewall foldably connected to the first sidewall opposite the back sidewall, wherein the second sidewall has a second sidewall top flap and a second sidewall bottom flap foldably connected to the second sidewall;

d) a second sidewall bottom flap extension foldably connected to the second sidewall bottom flap opposite the side second sidewall;

e) a third sidewall foldably connected to the front sidewall opposite the second sidewall, the third sidewall having a third sidewall top panel foldably connected to the third sidewall;

f) a fourth sidewall foldably connected to the third sidewall opposite the front sidewall, wherein the fourth sidewall has a fourth sidewall top flap and a fourth sidewall bottom flap foldably connected to the fourth sidewall;

g) a fourth sidewall bottom flap extension foldably connected to the fourth sidewall bottom flap opposite the fourth sidewall;

h) an inner sidewall foldably connected to the fourth sidewall opposite the third sidewall, the inner sidewall having inner sidewall stops and an inner bottom support panel foldably connected to the inner sidewall;

i) an inner sidewall flap foldably connected to the inner sidewall opposite the fourth sidewall;

j) a top panel foldably connected to the front sidewall and including an aperture for dispensing food product there through;

k) a bottom panel foldably connected to the front sidewall opposite the top panel; and l) a slide foldably connected to the front sidewall opposite the back sidewall.

2. The blank of claim 1, wherein the first sidewall top flap has a first slit and the fourth sidewall top flap has a second slit.

3. The blank of claim 2, wherein the top panel has a top panel first flap and a top panel second flap configured for insertion into the first slit and the second slit, respectively.

4. The blank of claim 1, wherein the back sidewall includes a back sidewall adhesive area.

5. The blank of claim 1, wherein an outer surface of the inner sidewall flap includes an inner sidewall adhesive area.

6. The blank of claim 1, wherein the slide includes angled stop portions and slide stops adjacent the angled stop portions.

7. A blank used to form a hexagonal shaped box, the blank having:

a) a front sidewall and a back sidewall, wherein the front sidewall is foldably connected to the back sidewall;

b) a first sidewall foldably connected to the back sidewall;

c) a second sidewall foldably connected to the first sidewall opposite the back sidewall;

d) a second sidewall bottom flap extension foldably connected to the second sidewall bottom flap opposite the side second sidewall;

e) a third sidewall foldably connected to the front sidewall opposite the second sidewall;

f) a fourth sidewall foldably connected to the third sidewall opposite the front sidewall;

g) a fourth sidewall bottom flap extension foldably connected to the fourth sidewall bottom flap opposite the fourth sidewall;

h) an inner sidewall foldably connected to the fourth sidewall opposite the third sidewall;

i) an inner sidewall flap foldably connected to the inner sidewall opposite the fourth sidewall;

j) a top panel foldably connected to the front sidewall and including an aperture for dispensing food product there through;

k) a bottom panel foldably connected to the front sidewall opposite the top panel; and l) a slide foldably connected to the front sidewall opposite the back sidewall.

8. The blank of claim 7, wherein the back sidewall includes a back sidewall adhesive area.

9. The blank of claim 7, wherein an outer surface of the inner sidewall flap includes an inner sidewall adhesive area.

10. The blank of claim 7, wherein the inner sidewall has inner sidewall stops and an inner bottom support panel foldably connected to the inner sidewall.

11. The blank of claim 7, wherein the slide includes angled stop portions and slide stops adjacent the angled stop portions.

12. The blank of claim 7, wherein the first sidewall top flap has a first slit and the fourth sidewall top flap has a second slit.

13. The blank of claim 12, wherein the top panel has a top panel first flap and a top panel second flap configured for insertion into the first slit and the second slit, respectively.

14. The blank of claim 7, wherein the first sidewall has a first sidewall top flap and a first sidewall bottom flap foldably connected to the first sidewall.

15. The blank of claim 7, wherein the second sidewall has a second sidewall top flap and a second sidewall bottom flap foldably connected to the second sidewall.

16. The blank of claim 7, wherein the third sidewall has a third sidewall top panel foldably connected to the third sidewall.

17. The blank of claim 7, wherein the fourth sidewall has a fourth sidewall top flap and a fourth sidewall bottom flap foldably connected to the fourth sidewall.

* * * * *